US009085005B2

(12) United States Patent
Townsend

(10) Patent No.: US 9,085,005 B2
(45) Date of Patent: Jul. 21, 2015

(54) AUTOMATIC NOZZLE CHANGER

(75) Inventor: Michael Townsend, Waitsburg, WA (US)

(73) Assignee: NELSON IRRIGATION CORPORATION, Walla Walla, WA (US)

( * ) Notice: Subject to any disclaimer, the term of this patent is extended or adjusted under 35 U.S.C. 154(b) by 1264 days.

(21) Appl. No.: 12/457,121

(22) Filed: Jun. 1, 2009

(65) Prior Publication Data

US 2010/0301130 A1 Dec. 2, 2010

(51) Int. Cl.

| | |
|---|---|
| ***A62C 31/02*** | (2006.01) |
| ***A62C 31/00*** | (2006.01) |
| ***B05B 1/32*** | (2006.01) |
| ***B05B 15/06*** | (2006.01) |
| ***B05B 1/16*** | (2006.01) |
| ***B05B 3/04*** | (2006.01) |
| *B05B 15/08* | (2006.01) |

(52) U.S. Cl.

CPC ..... *B05B 1/1681* (2013.01); *B05B 1/169* (2013.01); *B05B 3/0486* (2013.01); *B05B 15/08* (2013.01)

(58) Field of Classification Search

CPC ..... B05B 1/1681; B05B 1/169; B05B 1/16; B05B 1/1654; B05B 1/1645; B05B 15/08; B05B 15/065; B05B 15/10; B05B 12/002; B05B 3/0486; A01G 25/162

USPC ..... 239/394, 391, 392, 393, 396, 397, 436, 239/437, 438, 504, 505, 518, 523, 201, 208, 239/209, 541, 11, 66, 451–460, 395; 169/37; 401/109, 110, 111, 112

See application file for complete search history.

(56) References Cited

U.S. PATENT DOCUMENTS

| | | | | | |
|---|---|---|---|---|---|
| 1,979,179 | A | * | 10/1934 | Taylor | 239/85 |
| 2,944,705 | A | * | 7/1960 | Strumor | 222/94 |
| 3,124,162 | A | * | 3/1964 | Cameron | 137/625.11 |
| 3,191,809 | A | * | 6/1965 | Schultz et al. | 222/182 |
| 3,351,250 | A | * | 11/1967 | West | 222/532 |
| 3,385,525 | A | * | 5/1968 | Jacobs | 239/394 |
| 3,459,208 | A | * | 8/1969 | Clyde | 137/119.03 |
| 3,472,265 | A | * | 10/1969 | Davis | 137/119.03 |
| 3,596,835 | A | * | 8/1971 | Smith et al. | 239/394 |
| 3,642,022 | A | * | 2/1972 | Kirby | 137/119.03 |
| 3,779,533 | A | * | 12/1973 | Etter | 239/394 |
| 3,817,300 | A | * | 6/1974 | Donnet | 141/117 |
| 4,094,468 | A | * | 6/1978 | Volle | 239/394 |
| 4,116,216 | A | * | 9/1978 | Rosenberg | 137/624.13 |
| 4,221,334 | A | * | 9/1980 | Christopher | 239/394 |
| 4,290,707 | A | * | 9/1981 | Ariga | 401/110 |
| 5,183,322 | A | * | 2/1993 | Haruch | 239/394 |
| 5,232,161 | A | * | 8/1993 | Clemmons | 239/346 |
| 5,358,180 | A | * | 10/1994 | Prassas et al. | 239/391 |
| 5,386,940 | A | * | 2/1995 | Berfield | 239/394 |
| 5,415,348 | A | | 5/1995 | Nelson | |
| 5,762,269 | A | | 6/1998 | Sweet | |
| 5,862,543 | A | * | 1/1999 | Reynoso et al. | 4/541.6 |
| 5,884,847 | A | * | 3/1999 | Christopher | 239/390 |

(Continued)

*Primary Examiner* — Jason Boeckmann
*Assistant Examiner* — Steven M Cernoch
(74) *Attorney, Agent, or Firm* — Nixon & Vanderhye P.C.

(57) ABSTRACT

A sprinkler assembly includes a housing having an open side; a sprinkler body supported at one end of the housing and adapted to receive a nozzle. A nozzle magazine is attached to the housing along the open side and holds plural nozzles selectively alignable with said sprinkler body. An actuator is arranged to move a selected one of the plural nozzles from the nozzle magazine into the sprinkler body.

17 Claims, 37 Drawing Sheets

(56) References Cited

U.S. PATENT DOCUMENTS

| | | | | |
|---|---|---|---|---|
| 6,364,219 | B1 * | 4/2002 | Zimmerman et al. | 239/394 |
| 6,398,134 | B1 * | 6/2002 | Hickson et al. | 239/394 |
| 6,435,427 | B1 * | 8/2002 | Conroy | 239/392 |
| 6,438,766 | B1 * | 8/2002 | Capdevila Arnau et al. | 4/490 |
| 6,460,783 | B1 * | 10/2002 | Christopher | 239/394 |
| 6,651,909 | B1 * | 11/2003 | Bugarin | 239/390 |
| 6,749,134 | B2 * | 6/2004 | Arenson et al. | 239/393 |
| 6,772,964 | B2 * | 8/2004 | Funseth et al. | 239/436 |
| 6,988,677 | B2 * | 1/2006 | Sodemann et al. | 239/525 |
| 7,080,795 | B2 * | 7/2006 | Chen | 239/394 |
| 7,370,814 | B2 * | 5/2008 | Chih | 239/394 |
| 7,472,840 | B2 * | 1/2009 | Gregory | 239/289 |
| 7,475,833 | B2 * | 1/2009 | Chih | 239/394 |
| 7,717,131 | B2 * | 5/2010 | Creswell et al. | 137/625.46 |
| 7,980,490 | B2 * | 7/2011 | Waddelow et al. | 239/394 |
| 2002/0092928 | A1 * | 7/2002 | Conroy | 239/392 |
| 2012/0312898 | A1 * | 12/2012 | Sesser et al. | 239/394 |
| 2013/0015266 | A1 * | 1/2013 | Riley et al. | 239/302 |

* cited by examiner

AUTOMATIC NOZZLE CHANGER

This invention relates to sprinkler devices of the type typically utilized in connection with, but not limited to, conventional pivot-move and lateral-move irrigation systems and more specifically, to a sprinkler device which incorporates an automatic nozzle changer.

BACKGROUND OF THE INVENTION

Mobile irrigation systems such as conventional pivot-move and lateral-move systems typically incorporate truss-span assemblies which mount sprinkler heads spaced along the truss span for irrigating relatively large areas of land. The sprinkler heads may be mounted on top of the truss-span in a normal upright position, or they may be inverted and suspended from the truss-span by means of drop tubes or the like.

Because of the large number of sprinkling heads utilized in a conventional pivot-move or lateral-move irrigation system, and because of the remote locations of such systems, it is important to be able to replace, and/or repair sprinkler heads simply, quickly and efficiently. The assignee currently manufactures modular spray heads which include a sprinkler body adapted to accept interchangeable nozzles and spray plates. In commonly-owned U.S. Pat. No. 5,415,348, for example, a modular sprinkler assembly is disclosed which incorporates an easily identifiable and changeable nozzle sandwiched between the sprinkler body and a hose adapter. Changing the nozzle, however, requires disassembly of the sprinkler. In commonly-owned U.S. Pat. No. 5,762,269, there is disclosed a sprinkler incorporating a nozzle clip that holds a second alternatively useable nozzle laterally adjacent to a first installed nozzle. The clip is manually reversible such that the first and second nozzles are selectively interchangeable.

There remains a need, however, for the sprinkler device that incorporates a number of selectively useable nozzles of varying orifice size, and wherein the nozzles may be changed automatically on site or from remote locations.

BRIEF SUMMARY OF THE INVENTION

In an exemplary but nonlimiting embodiment, the present invention enables an operator to automatically change the flow rate of a single sprinkler or the flow rates of plural sprinklers in a multi-sprinkler irrigation system (uniformly or differentially). This is achieved by incorporating a nozzle magazine carrying a plurality of interchangeable nozzles of different size (i.e., flow rate) which will permit a single sprinkler to have, for example, three alternatively specified flow rates. To this end, a hydraulic or pneumatic actuator is employed with a control system that automatically implements a nozzle-change cycle. An irrigation system incorporating this technology may be used for site-specific irrigation or other applications where, for example, the water flow rate needs to be varied for all sprinklers at specified time intervals, or for individual sprinklers at individually-specified time intervals, along the length of a truss span.

In another example, a circle-pivot irrigation system irrigating a sensitive crop may require light watering for germination, increased watering after the crop emerges, and even more watering as the crop matures. The automatic nozzle changer as described herein has the ability not only to accommodate the various growth stages of the crop, but also saves water by using only the amount of water needed at specific times.

It is another feature of the invention that the nozzle-changer assembly actuators may be controlled by wireless communication using GPS, RFID tags, etc. with a suitably programmed microprocessor on site or at a remote location.

Accordingly, in a first exemplary but nonlimiting embodiment, the invention relates to a sprinkler assembly comprising: a housing having an open side; a sprinkler body supported at one end of the housing and adapted to receive a nozzle; a nozzle magazine attached to the housing along the open side and holding plural nozzles selectively alignable with the sprinkler body; and an actuator for moving a selected one of the plural nozzles from the nozzle magazine into the nozzle body.

In another aspect, the invention relates to a nozzle magazine for use with a sprinkler to enable nozzles of varying size to be interchangeably inserted into the sprinkler, the nozzle magazine comprising: a spindle having upper and lower ends defining an axis of rotation; a nozzle tray adjacent one end of the spindle, the nozzle tray having plural through-holes, each supporting a respective nozzle; and wherein an opposite end of the spindle is formed with a compound cam groove adapted for interaction with an actuator cam, said compound cam groove arranged to rotate the nozzle magazine in a first angular direction upon movement of said actuator cam in a first linear direction, and to rotate the nozzle magazine further in said first angular direction upon movement of said actuator cam in a second linear direction opposite said first linear direction.

In still another aspect, the invention relates to a method of changing a nozzle in a sprinkler head comprising:

(a) providing a rotatable nozzle magazine holding a plurality of nozzles, one of said nozzles located in said sprinkler head;

(b) retracting said one nozzle and, during retraction, rotating said nozzle magazine in a first direction through a first predetermined angle;

(c) advancing another of said nozzles towards said sprinkler head and, while advancing, further rotating said nozzle magazine in said first direction through a second predetermined angle to thereby place said another of said nozzles in axial alignment with said sprinkler head; and (d) without further rotation of said nozzle magazine, inserting said another of said nozzles into said sprinkler body.

The invention will now be described in greater detail in connection with the drawings identified below:

DETAILED DESCRIPTION OF THE DRAWINGS

Figure 9:
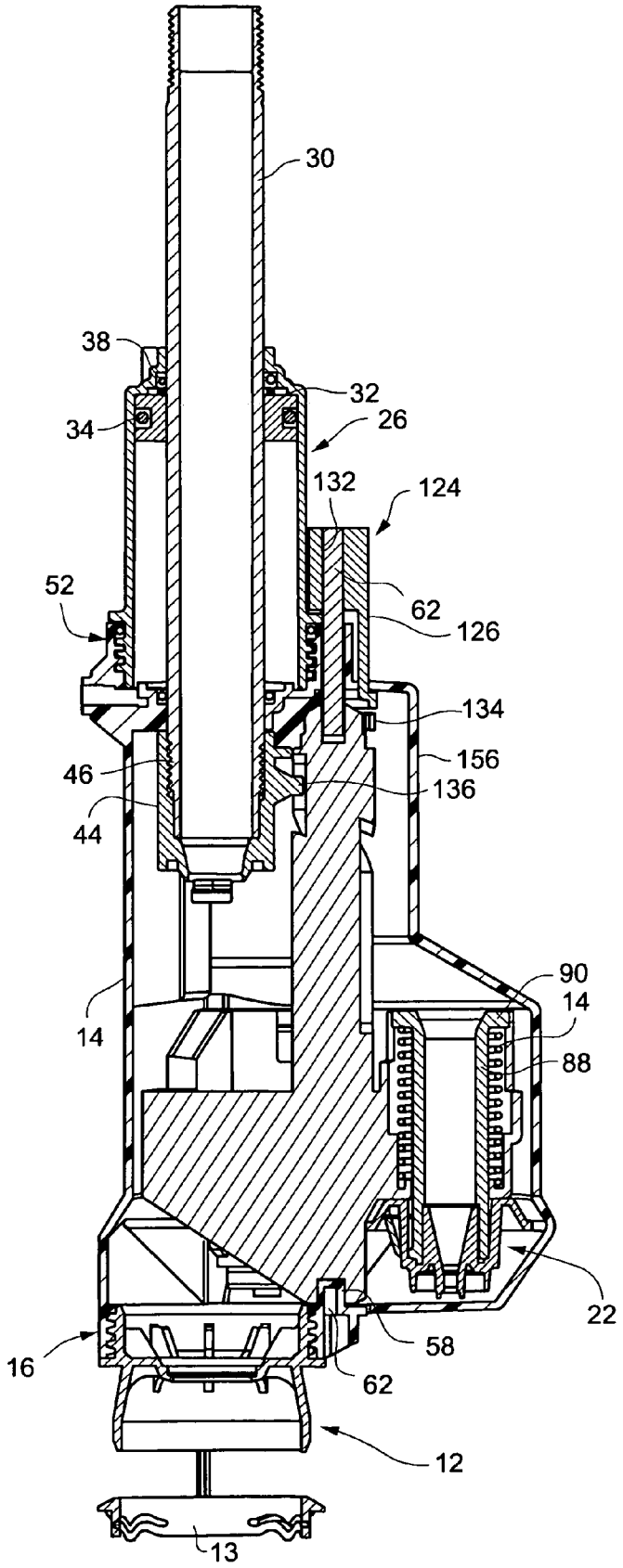
FIG. 9 is a section taken along the line 9-9 in FIG. 2.
Figure 10:
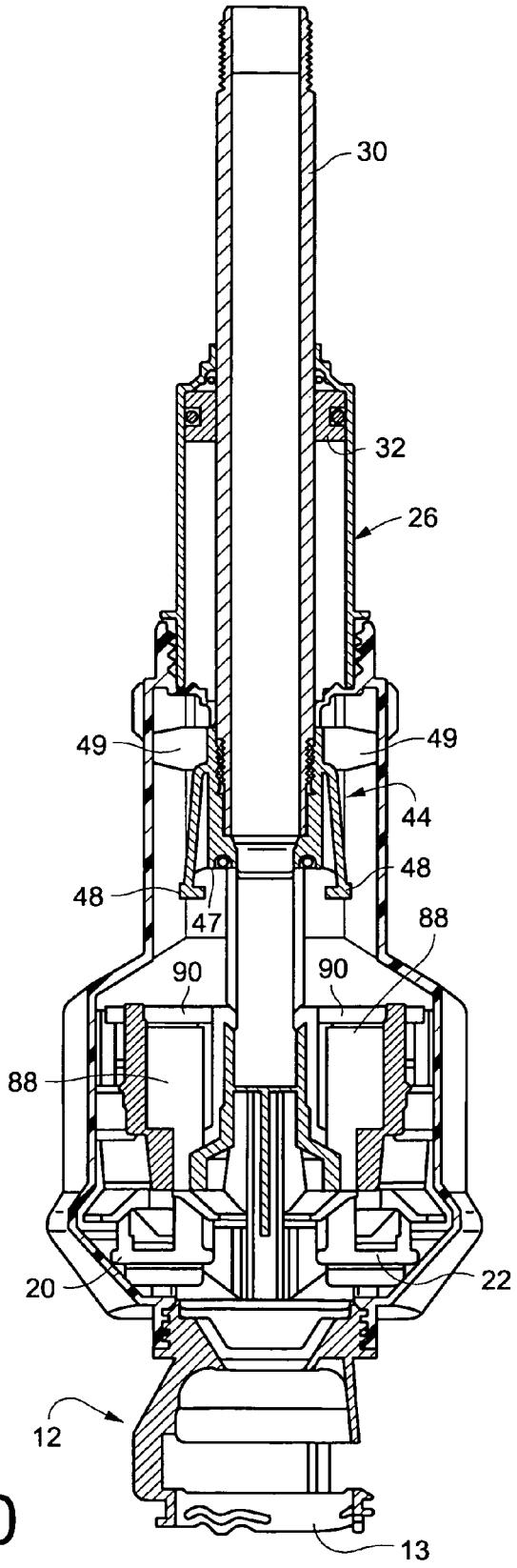
FIG. 10 is a section taken through the assembly shown in FIG. 1, but rotated 90°.

With initial reference to FIGS. 1-4, sprinkler assembly 10 in accordance with a first exemplary but nonlimiting embodiment includes generally a sprinkler body 12 connected to a hollow elongated housing 14 by means of a threaded connection shown at 16 (FIG. 9). It will be appreciated that the sprinkler body mounts a conventional water distribution plate (not shown) to the securement ring 13. The housing 14 has an open side which receives and supports a nozzle magazine 18 (or simply, magazine) adapted to hold a plurality of interchangeable nozzles 20, 22 and 24 (see FIGS. 4 and 6) of conventional construction. An actuator assembly (or actuator) 26, best seen in FIG. 3, includes a hydraulic or pneumatic cylinder 28 and a hollow piston rod 30 fitted with a piston 32 moveable within the cylinder 28. The cylinder is ported at its upper and lower ends in conventional fashion, permitting the piston to be driven in either direction. An annular piston ring or seal 34, located within a groove formed in the piston, seals against the internal surface of the cylinder 28 in conventional fashion. At the upper end of the cylinder 28, an upper retaining ring 36 holds an annular, upper rod seal 38 in place, while a lower retaining ring 40 and a lower rod seal 42 are arranged to seal the lower end of the cylinder against the housing as shown in FIG. 9. The upper end of the piston rod 30 is adapted to be connected to a flexible water supply hose or conduit (not shown). In this regard, it will be appreciated that the water under pressure will flow through the piston rod 30 and through the nozzle magazine before reaching the installed nozzle.

Figure 11:
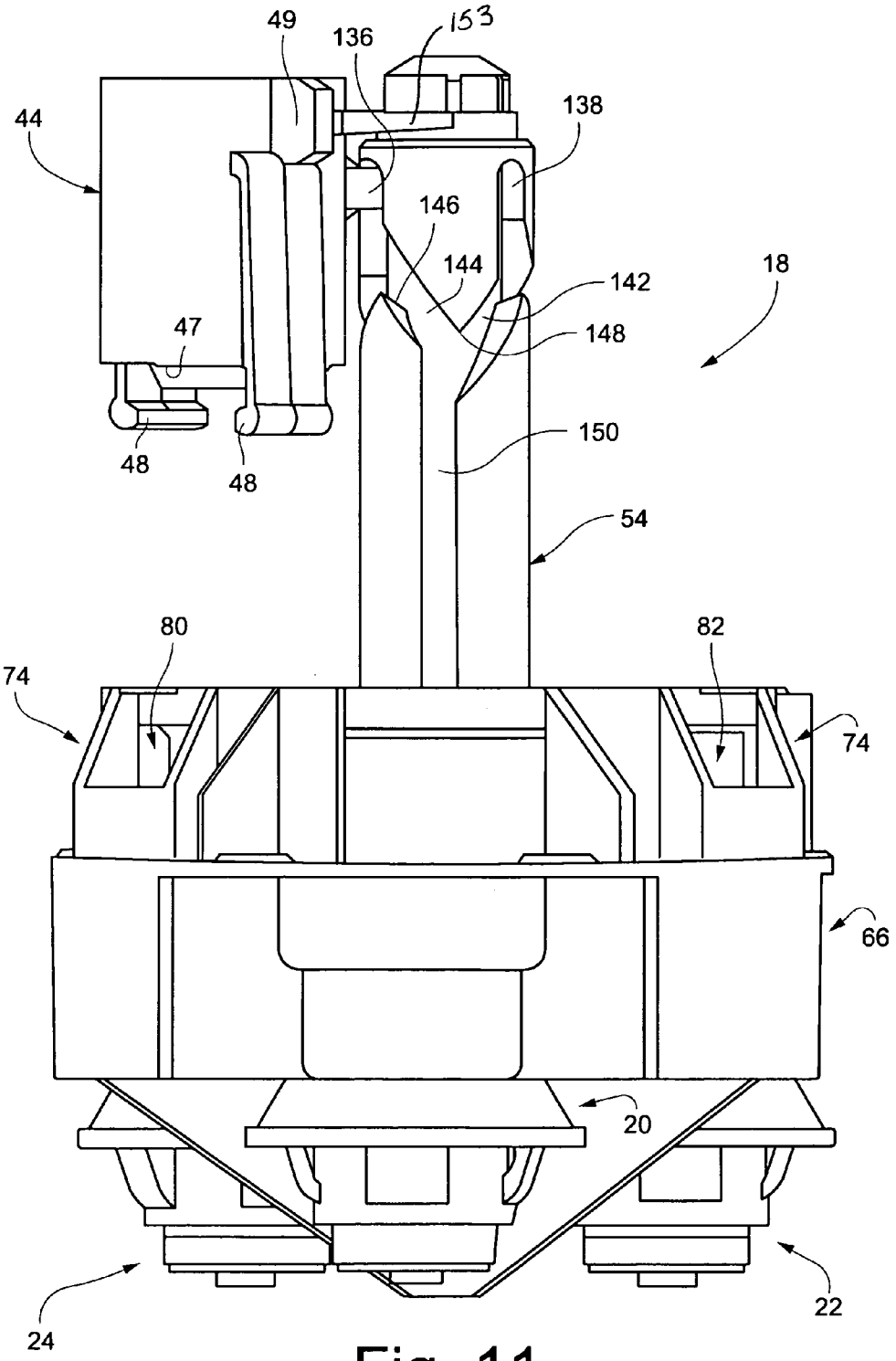
FIG. 11 is an elevation of the nozzle magazine assembly similar to FIG. 5 but with the actuator head attached in a fully retracted position.
Figure 12:
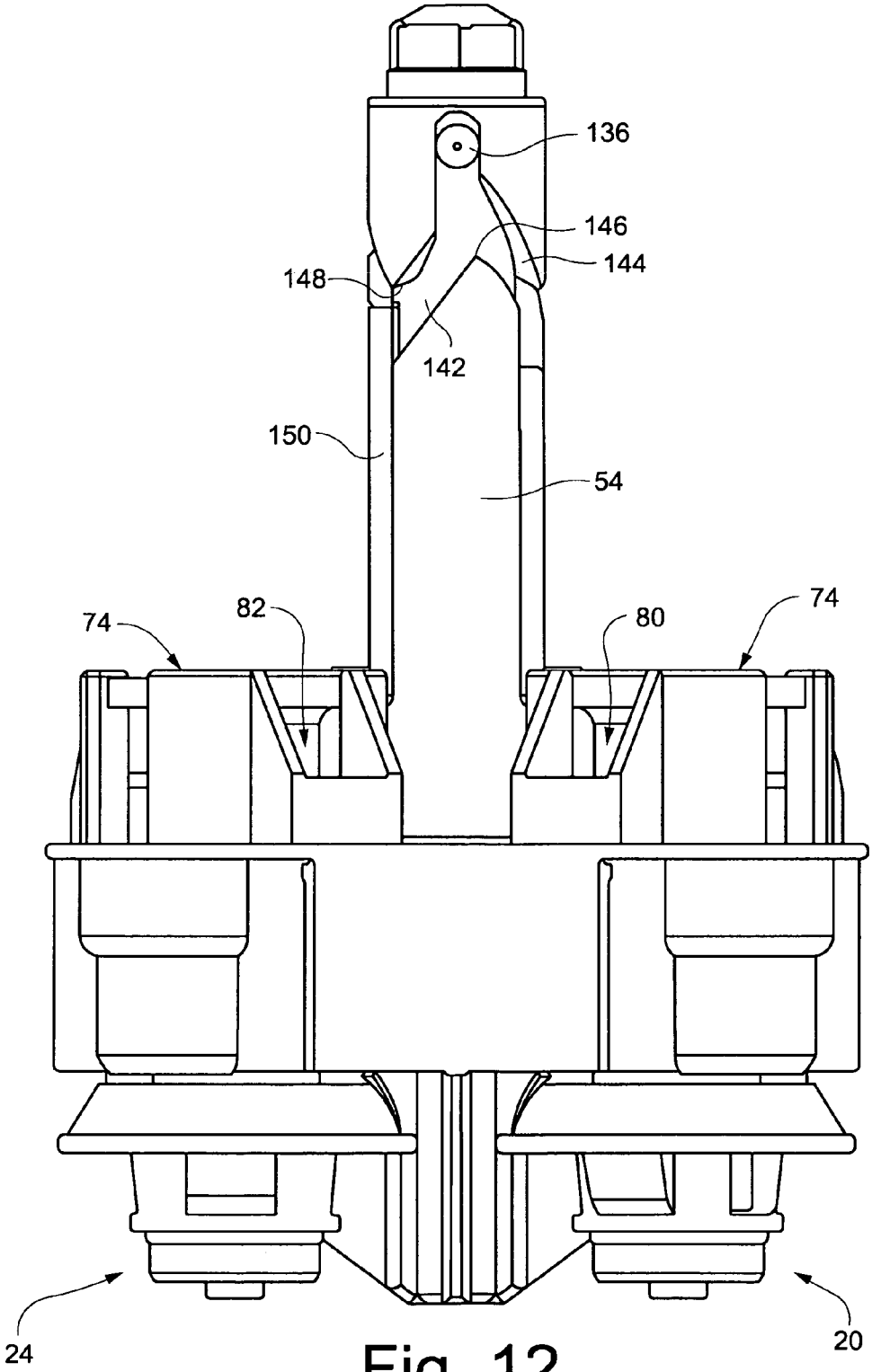
FIG. 12 is a view similar to FIG. 11 but rotated to the right 45° and with only the magazine cam post shown in the cam groove for the sake of clarity.
Figure 16:
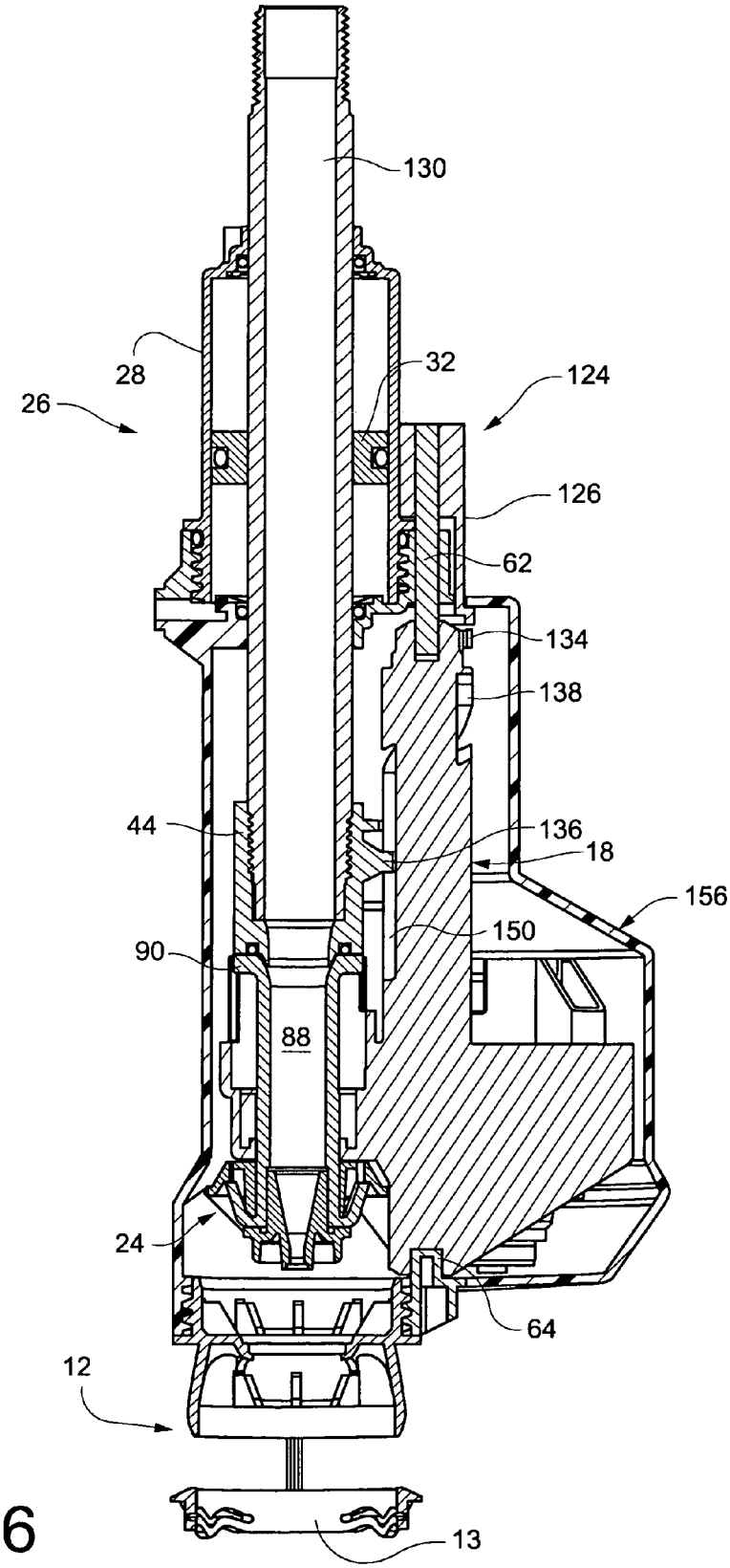
FIG. 16 is a section view of the sprinkler and nozzle changer assembly with the actuator cam post and nozzle magazine in a position generally corresponding to that shown in FIG. 15.

At the lower end of the piston rod 30, a piston rod nosepiece (sometimes referred to as a nozzle insertion tool) 44 is secured to the piston rod 30 by means of a threaded connection at 46. The nosepiece 44 is effectively a nozzle insertion/removal tool and to this end is provided with an annular pusher surface 47 for effecting insertion of a selected nozzle (20, 22 or 24) into the sprinkler body 12, and a pair of gripper arms 48 (best seen in FIG. 11) for retracting the selected nozzle from the sprinkler body 12 in a nozzle-change cycle described further herein. A pair of radially extending tabs 49 engage flat surfaces in the housing 14, preventing the piston rod 30 and nosepiece 44 from rotating during advance and retraction movements and thus maintaining correct positioning of the cam post 136 relative to the compound cam groove 140. (See, for example, FIGS. 10, 19, 20, 21 and 39.) An annular face seal 50 is provided at the lower end of the nosepiece 44 for sealing against a flange 90 of a nozzle-holding sleeve 88 (see FIG. 16) as described further herein.

The hollow piston rod 30 and the nosepiece 44 are moveable in up and down directions relative to the fixed cylinder 28, housing 14 and sprinkler body 12. In this regard, the cylinder 28 is secured to the housing 14 by means of a threaded connection shown at 52. (See FIG. 19.) As will be explained further herein, the actuator 26 and nosepiece 44 are used to insert a nozzle (20, 22 or 24) held in the magazine 18 into the sprinkler body 12, and to remove that nozzle and replace it with another nozzle (also held in the magazine) when desired. In this regard, the magazine 18 is able to rotate or index to a position where a selected one of the nozzles 20, 22 or 24 is axially aligned with the piston rod 30 and nosepiece 44.

Figure 30:
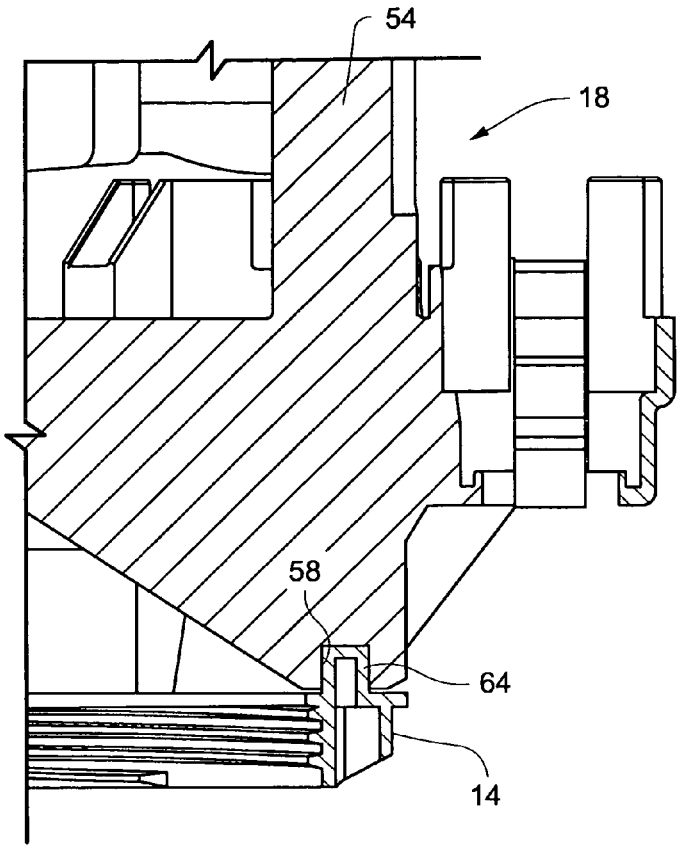
FIG. 30 is a partial section view showing the connection between the lower end of the nozzle magazine and the housing.
Figure 31:
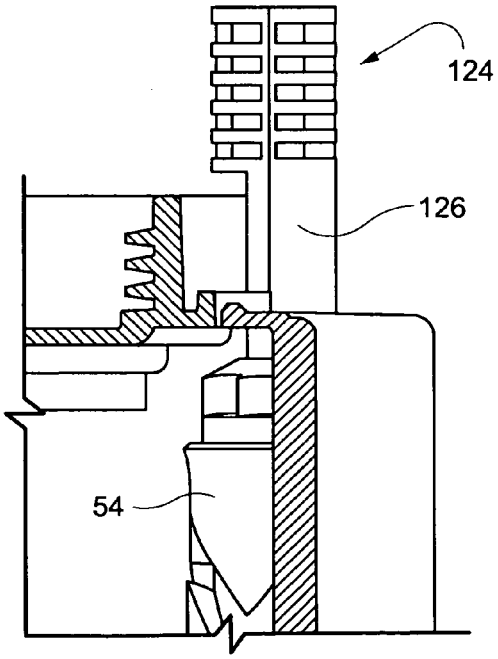
FIG. 31 is a partial section view showing the connection between the upper end of the nozzle magazine and the housing.

With reference especially to FIGS. 4-8 and 16, the magazine 18 is formed with a center spindle 54 which, when assembled, extends parallel and adjacent to the actuator piston rod 30. The spindle 54 is provided with upper and lower recesses 56, 58 which together define an axis of rotation for the magazine 18. The upper and lower recesses 56, 58 are engaged by a retaining pin 62 and a boss 64, respectively. (See also FIG. 30.)

Figure 1:
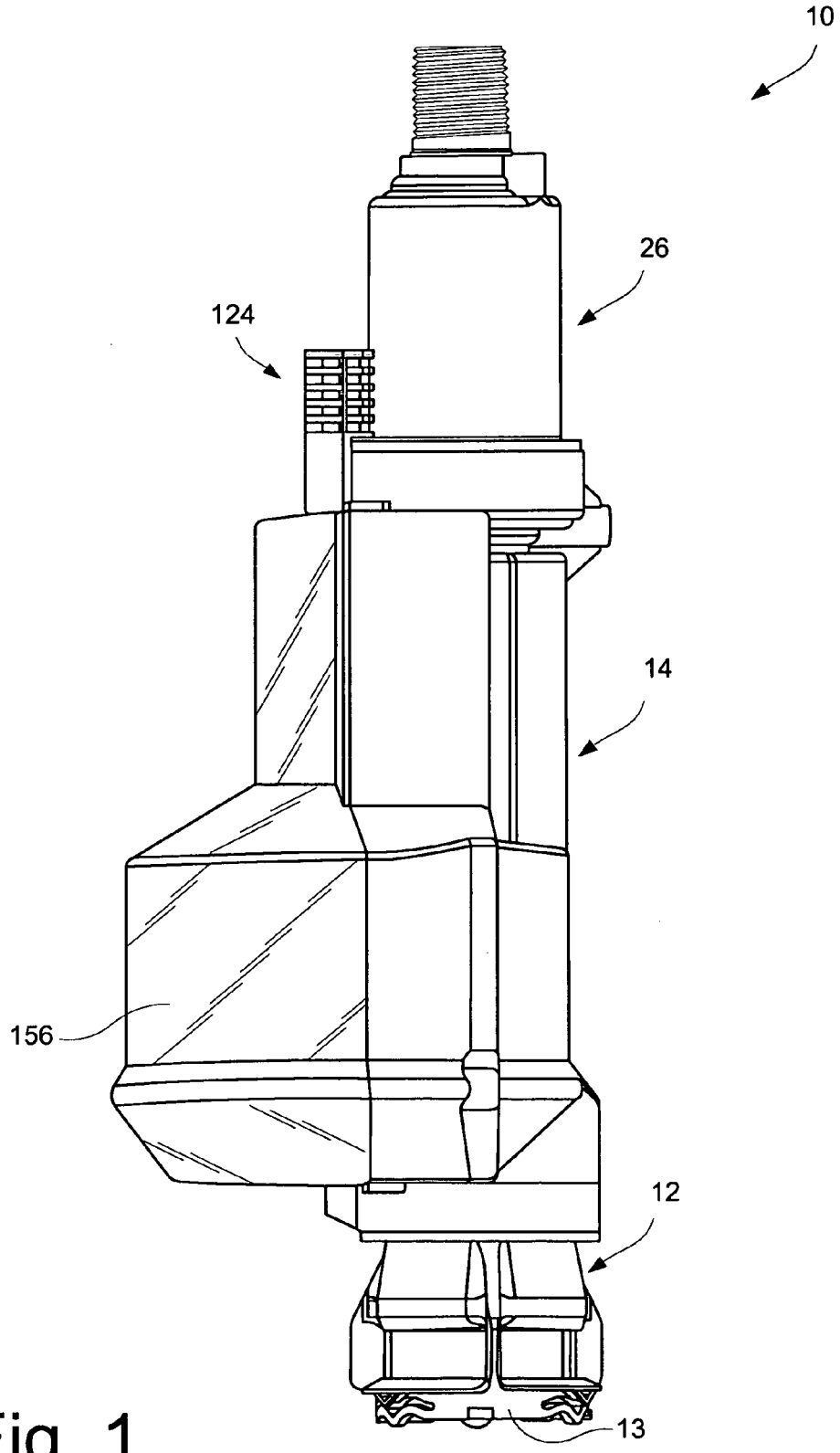
FIG. 1 is a side elevation of a sprinkler and nozzle changer assembly in accordance with an exemplary but nonlimiting embodiment of the invention.
Figure 2:
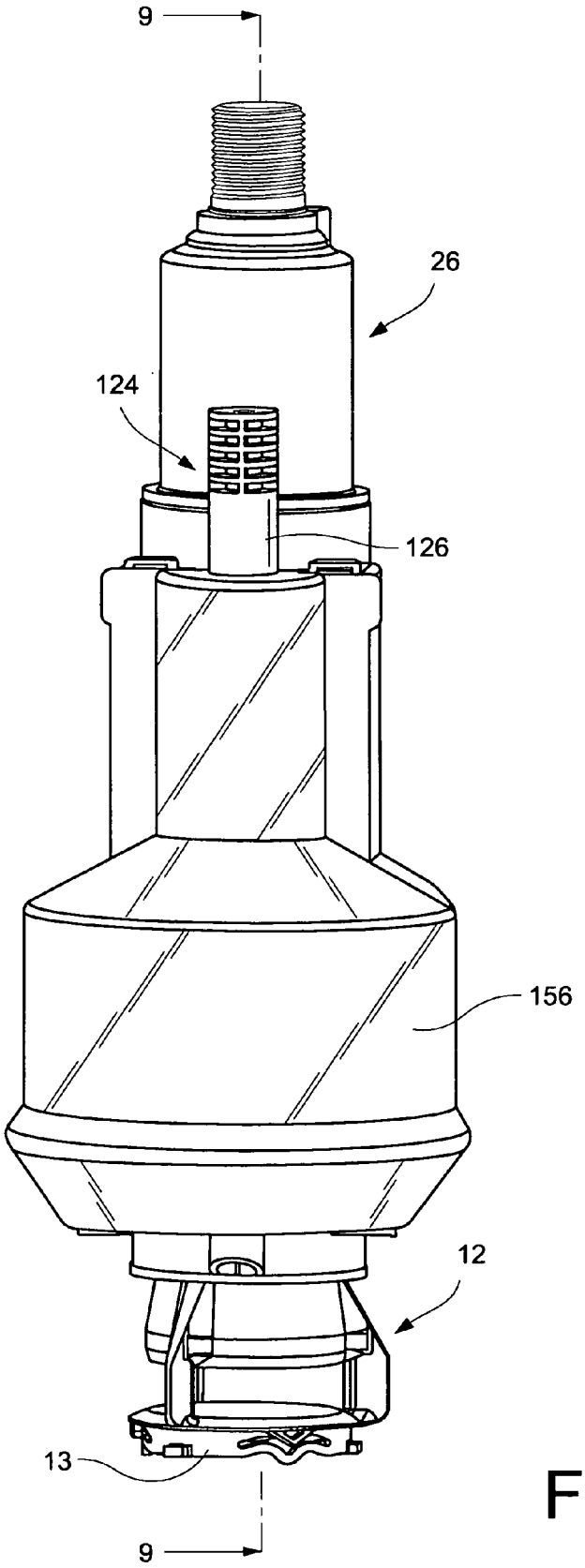
FIG. 2 is a front elevation view of the assembly shown in FIG. 1.
Figure 3:
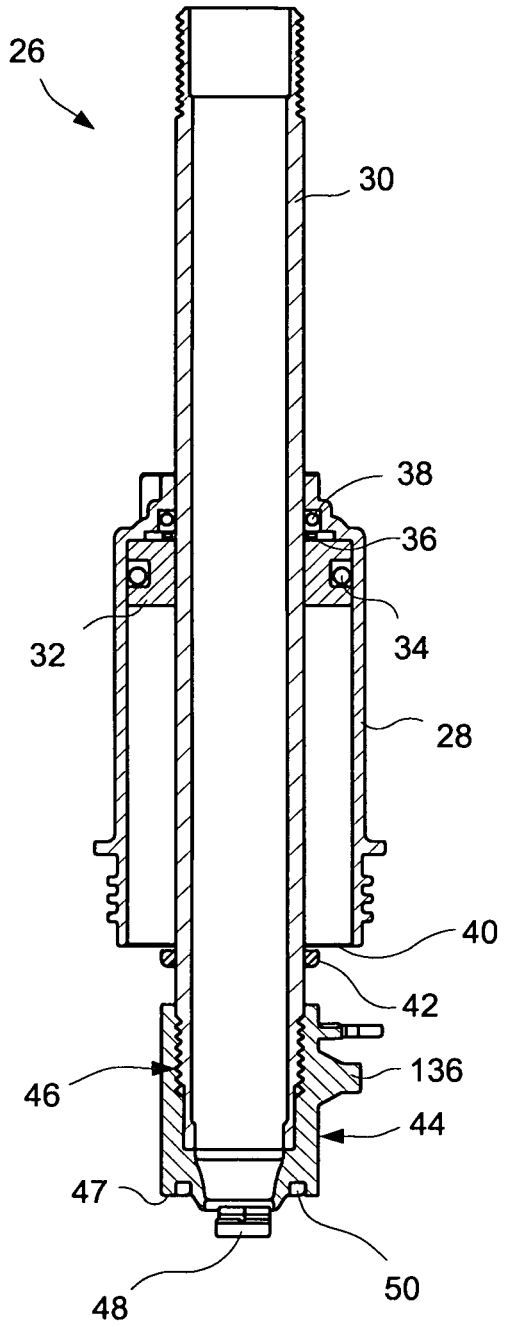
FIG. 3 is a cross section through an actuator assembly removed from the device shown in FIGS. 1 and 2.
Figure 4:
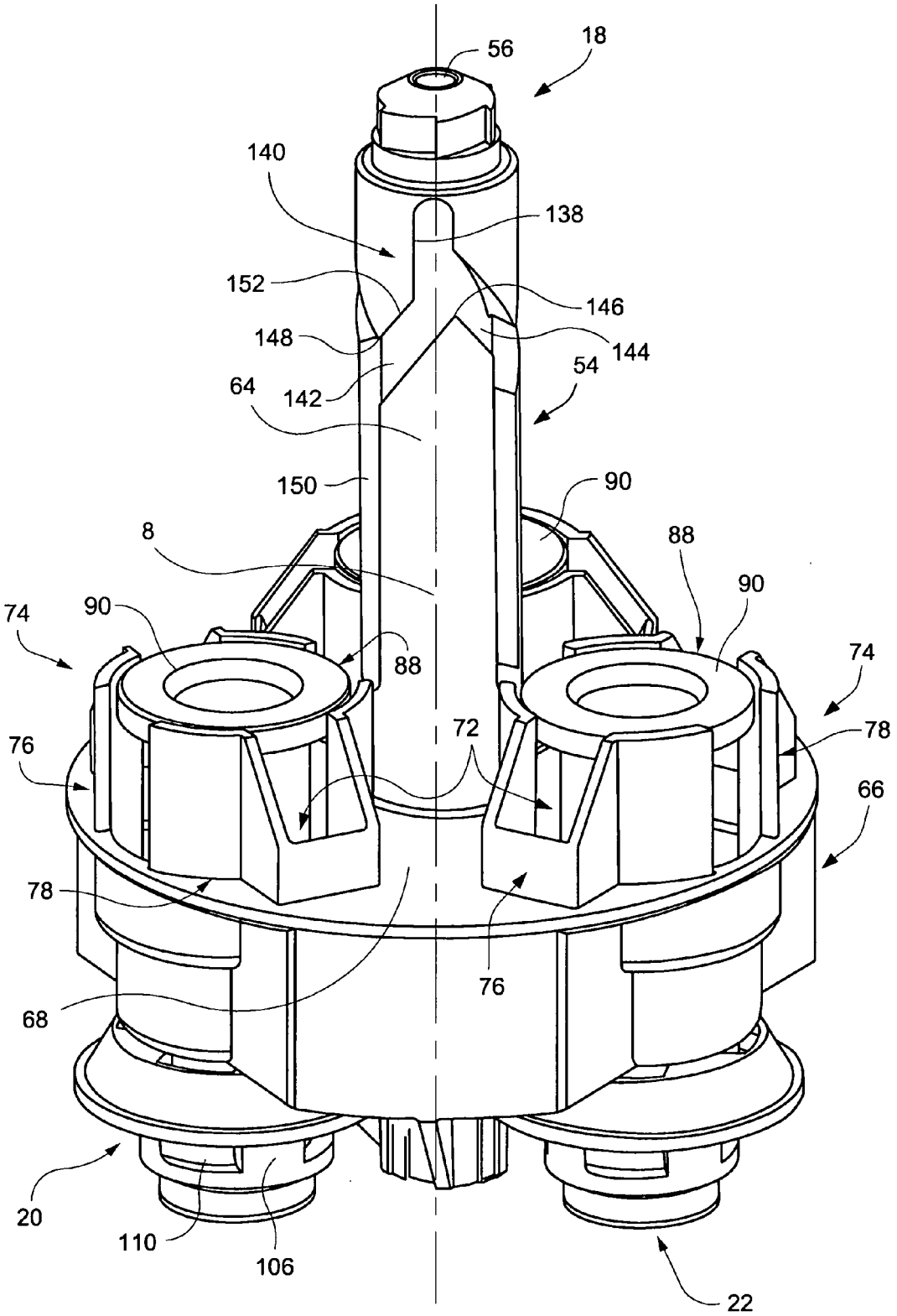
FIG. 4 is an enlarged perspective view of a nozzle magazine removed from the assembly shown in FIGS. 1 and 2.
Figure 5:
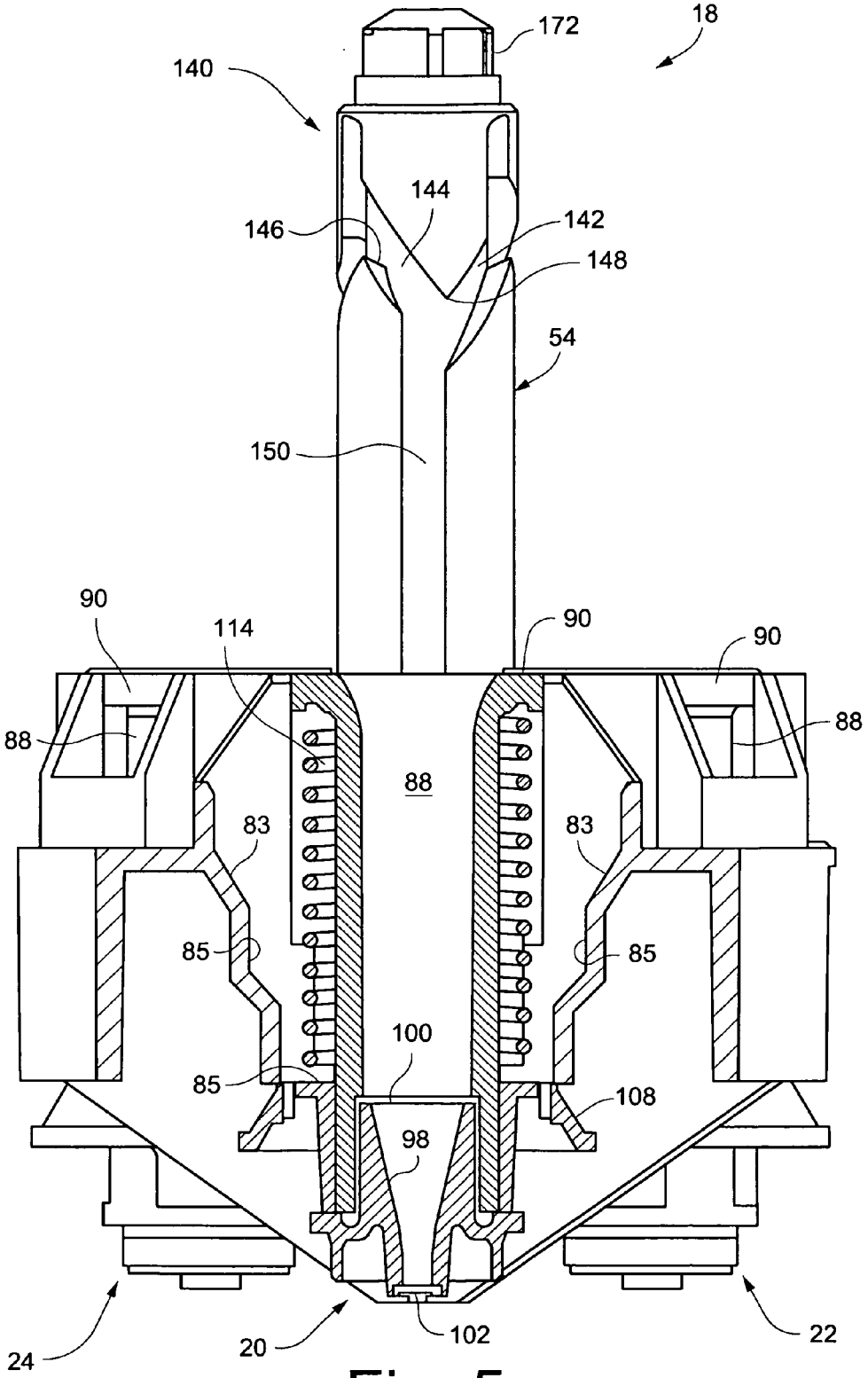
FIG. 5 is a section through the nozzle magazine shown in FIG. 4 but rotated 180°.
Figure 6:
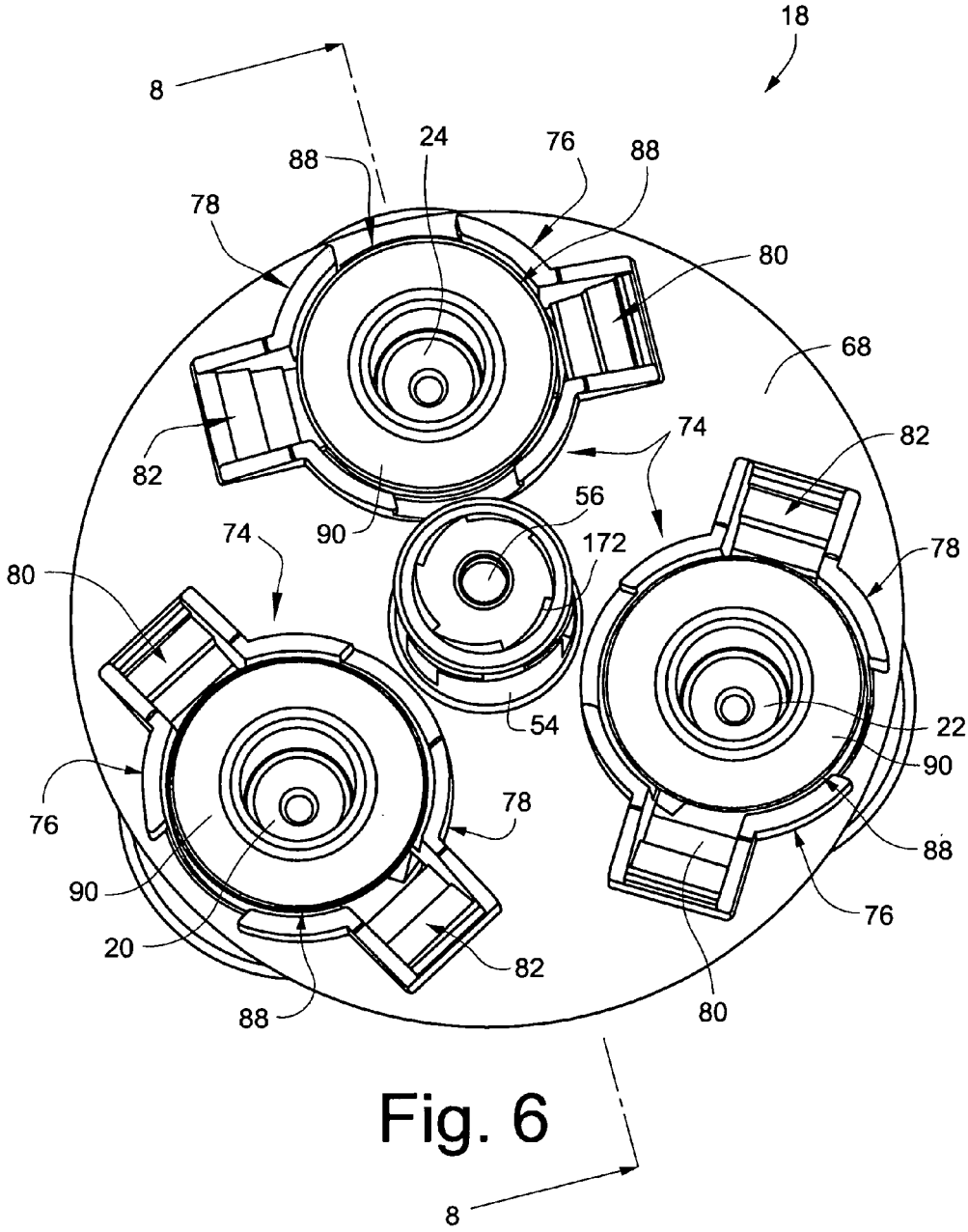
FIG. 6 is a top perspective view of the assembly shown in FIG. 4.
Figure 7:
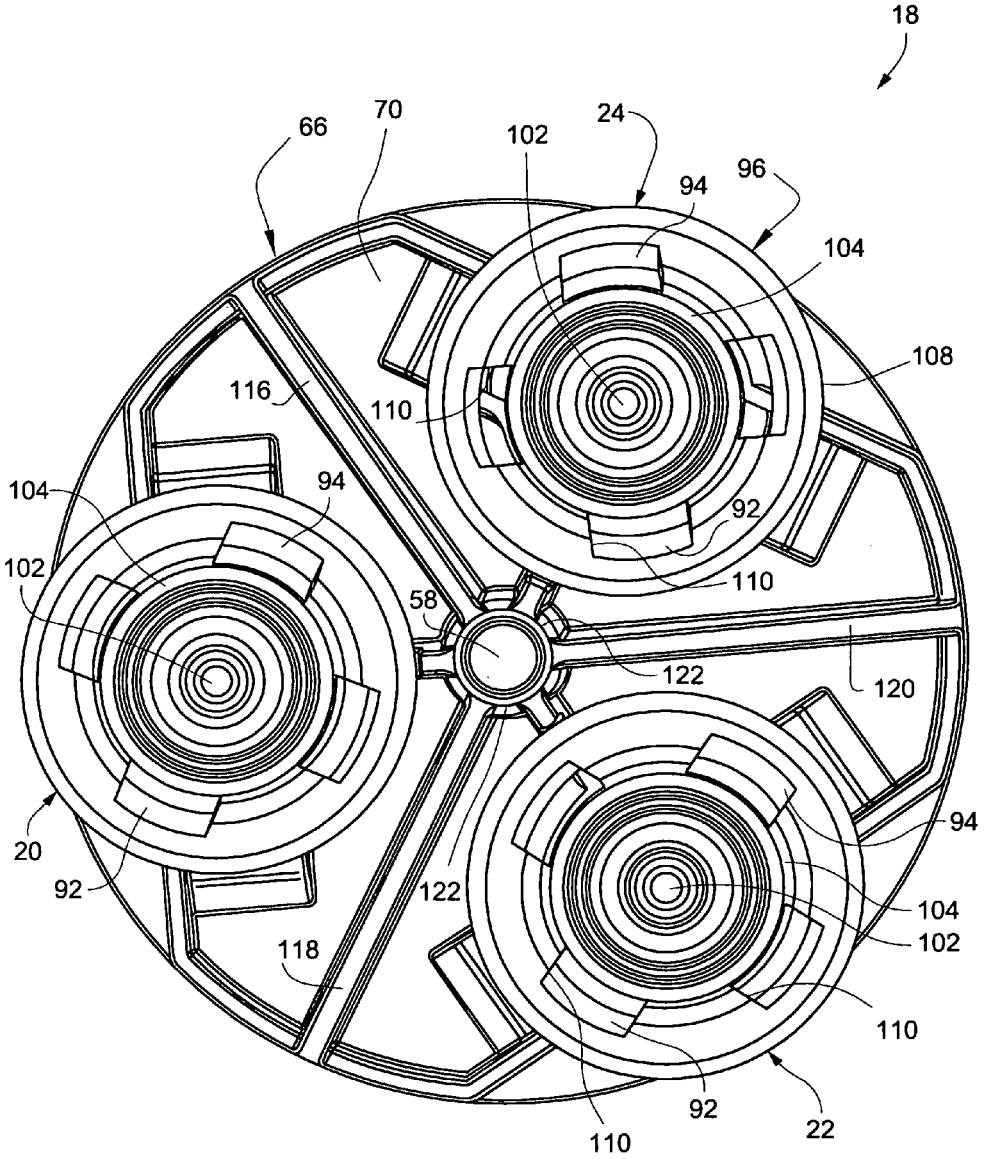
FIG. 7 is a bottom plan view of the assembly shown in FIG. 4.

The magazine 18 is also formed with a round tray body 66 adjacent the lower end of the spindle 54. The tray body 66 has an upper surface 68 and a lower surface 70. In the exemplary embodiment, the tray body is formed with three axially-oriented, equally-spaced openings 72 that extend through the tray body. Each opening 72 is generally cylindrical in shape, and is defined in part by an upper wall 74 substantially surrounding the respective opening and comprised of a pair of generally arcuate, diametrically-opposed wall portions 76, 78, as best seen in FIGS. 5 and 6. Centrally located within the respective arcuate wall portions 76, 78 are radially inwardly facing, tapered cam slots 80, 82, respectively, extending into the openings 72. In addition, each opening 72 is formed with a counter-bored portion 84 and a lower exit flange 86 (FIG. 5). The tapered and stepped contour of the slots 80, 82 controls the movement of the gripper arms 48 to the extent of providing the timing for clamp and release functions relative to the nozzle holding sleeves 88 described below.

A cylindrical nozzle-holding sleeve 88 is slidably received within each of the three openings 72 as best seen in FIG. 5. Each nozzle-holding sleeve 88 is formed with a radially outwardly extending flange 90 at its upper end that, in a nozzle retraction position, lies substantially flush with the upper edge of the wall 74; and a pair of diametrically-opposed, reverse-bend spring tabs 92, 94 (FIG. 5) at its lower end, adapted to hold a respective one of the nozzles. Because the nozzles 20, 22 and 24 and their respective nozzle-holding sleeves 88 are identical, only one of each need be described in detail. Nozzle 20, for example, includes a nozzle body 96 formed with an internal tapered surface 98 extending between an inlet 100 and an outlet orifice 102. A lower annular ring portion of the nozzle body includes a radial flange 104 that supports a plurality (four in the example embodiment) of equally-spaced upwardly-extending spokes or struts 106 that terminate at an angled identification ring or flange 108. The flange 108 may include nozzle size data or the like visible to the user. The spokes or struts 106 define a plurality of circumferentially-spaced openings 110. When the nozzle 20 is inserted within the counter-bored portion 84 at the lower end of the nozzle-holding sleeve 88 (best seen in FIGS. 5 and 8), the lower spring tabs 92, 94 are initially compressed as the nozzle moves into the sleeve. The spring tabs expand radially outwardly as they are received within a respective pair of the openings 110. The nozzle 20 is thus retained on the nozzle sleeve 88 and remains so attached for all nozzle-change operations described further herein. It will be understood, however, that individual nozzles may be easily replaced within the respective nozzle sleeves as desired. An O-ring seal 112 seals the bottom edge of the sleeve 88 to the nozzle.

Figure 8:
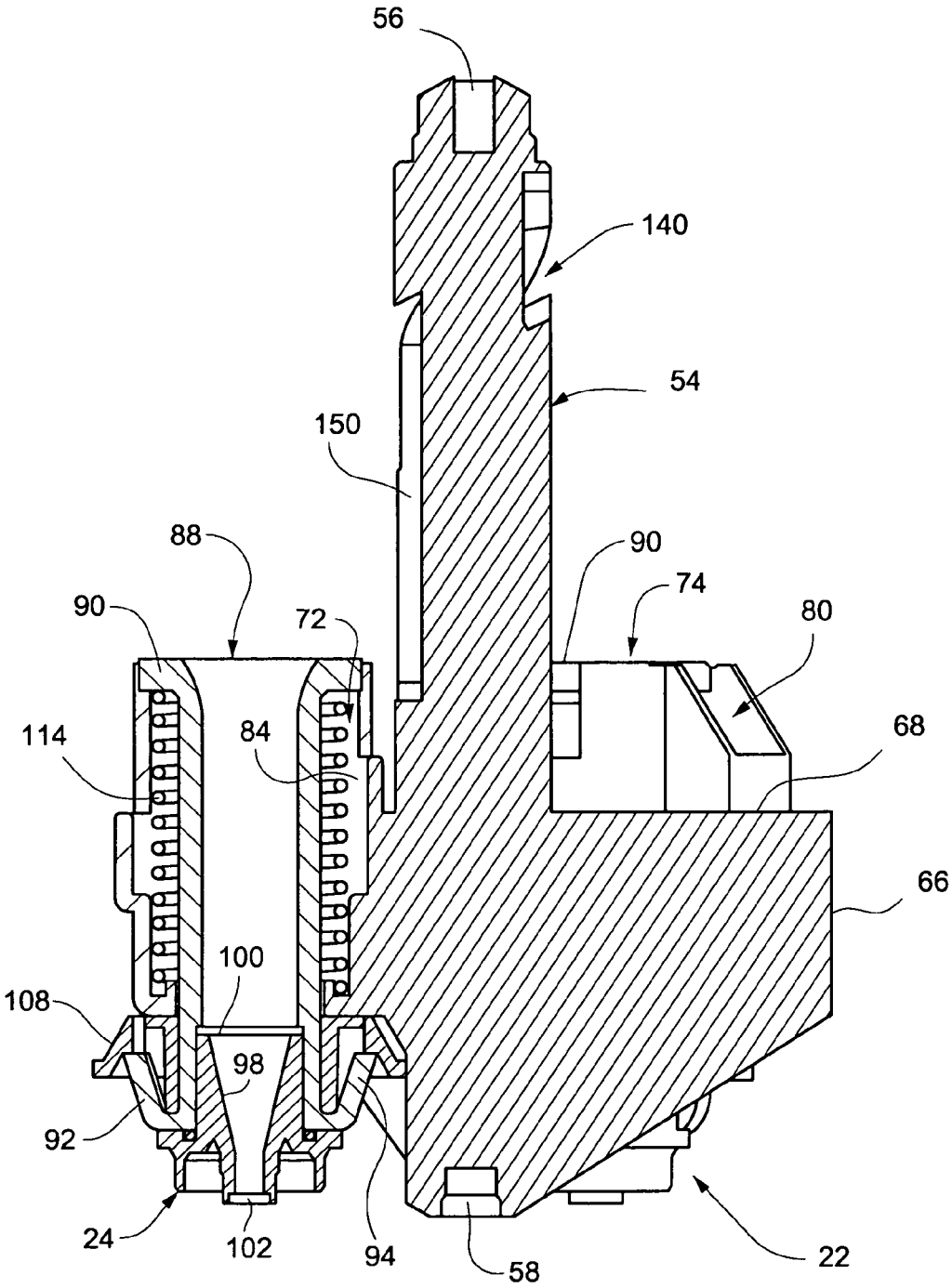
FIG. 8 is a section taken along the line 8-8 in FIG. 6.

For each cylindrical nozzle sleeve 88, there is a coil spring (or other equivalent) 114 engaged between the underside of the upper annular flange 90 and the inside surface of the lower flange 86 of the respective opening 72 (shown only in FIGS. 5 and 8) that normally maintains a nozzle sleeve 88 in the neutral position shown in FIGS. 5 and 8 when that nozzle is not in use. For an installed nozzle, the spring 114 insures that the nozzle-holding sleeve will be pushed upwardly during retraction sufficiently to allow the magazine to rotate as described in greater detail below.

On the underside of the nozzle magazine 18, there are arranged three reinforcing or support webs 116, 118 and 120 extending between the lower surface 70 and the lower boss 122 which defines the lower recess 58. This aspect of the construction is exemplary only, and may be varied as desired for ease of manufacture, etc.

Figure 34:
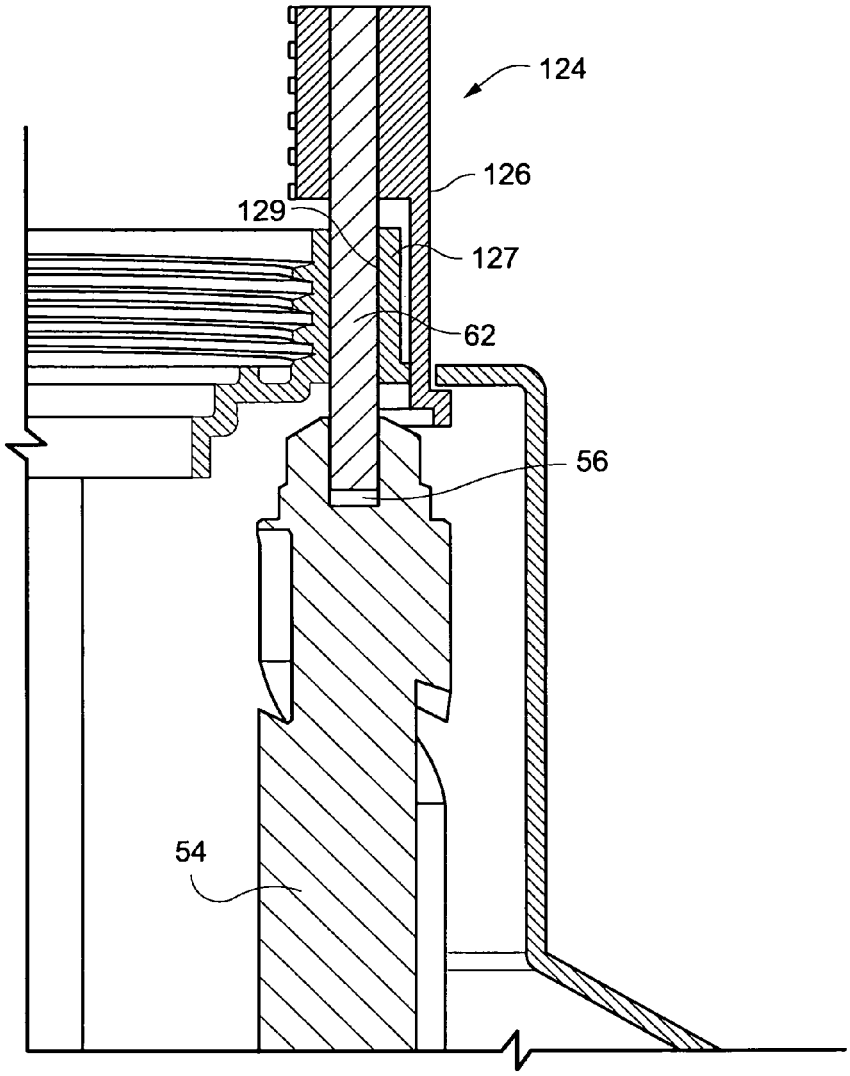
FIG. 34 is a section view of the nozzle retaining pin assembly engaged with the spindle.
Figure 35:
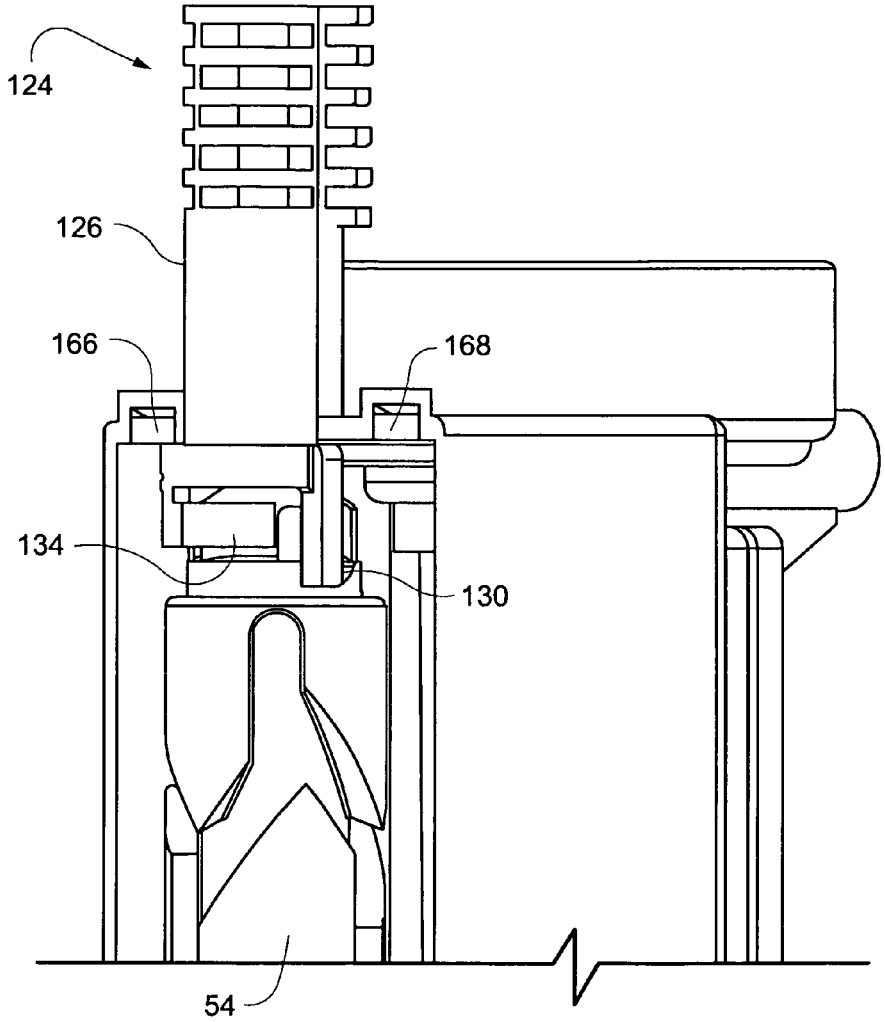
FIG. 35 is a partial elevation showing the retaining pin assembly in a raised position relative to the nozzle magazine and housing.
Figure 36:
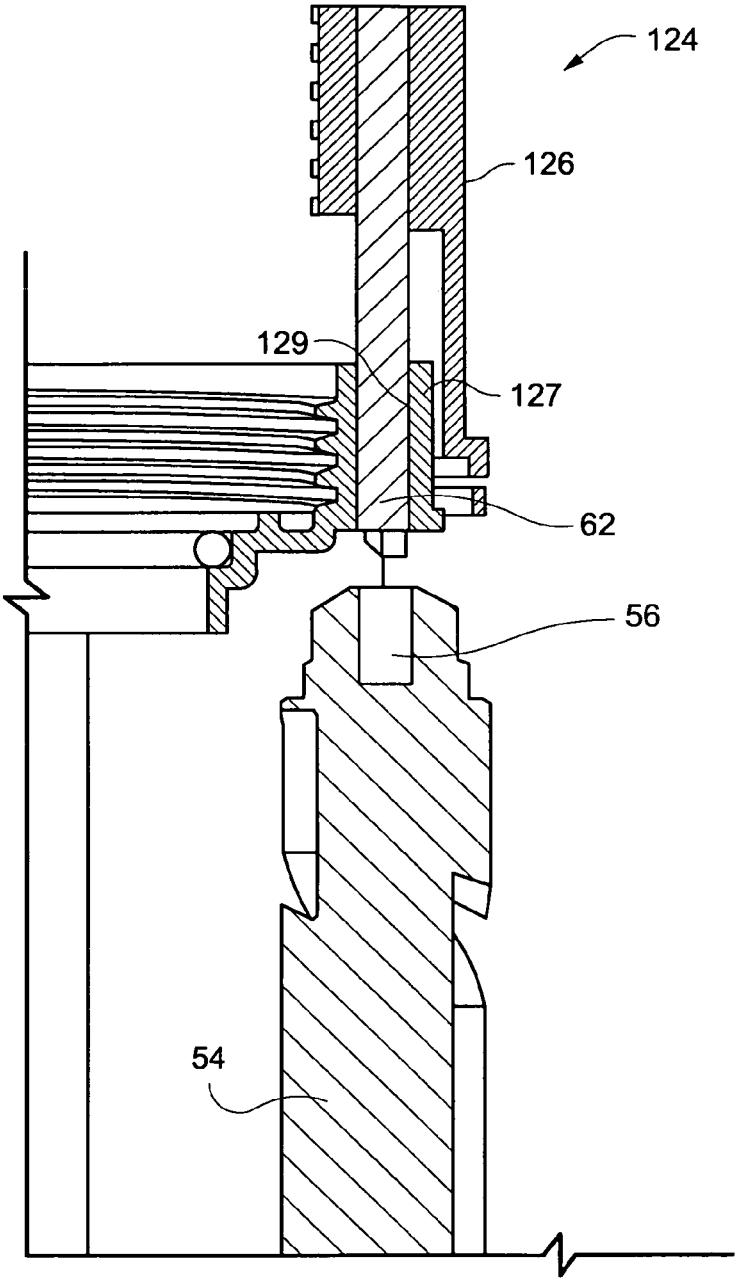
FIG. 36 is a partial elevation showing the retaining pin assembly in a lowered position, locking the nozzle magazine to the housing.
Figure 37:
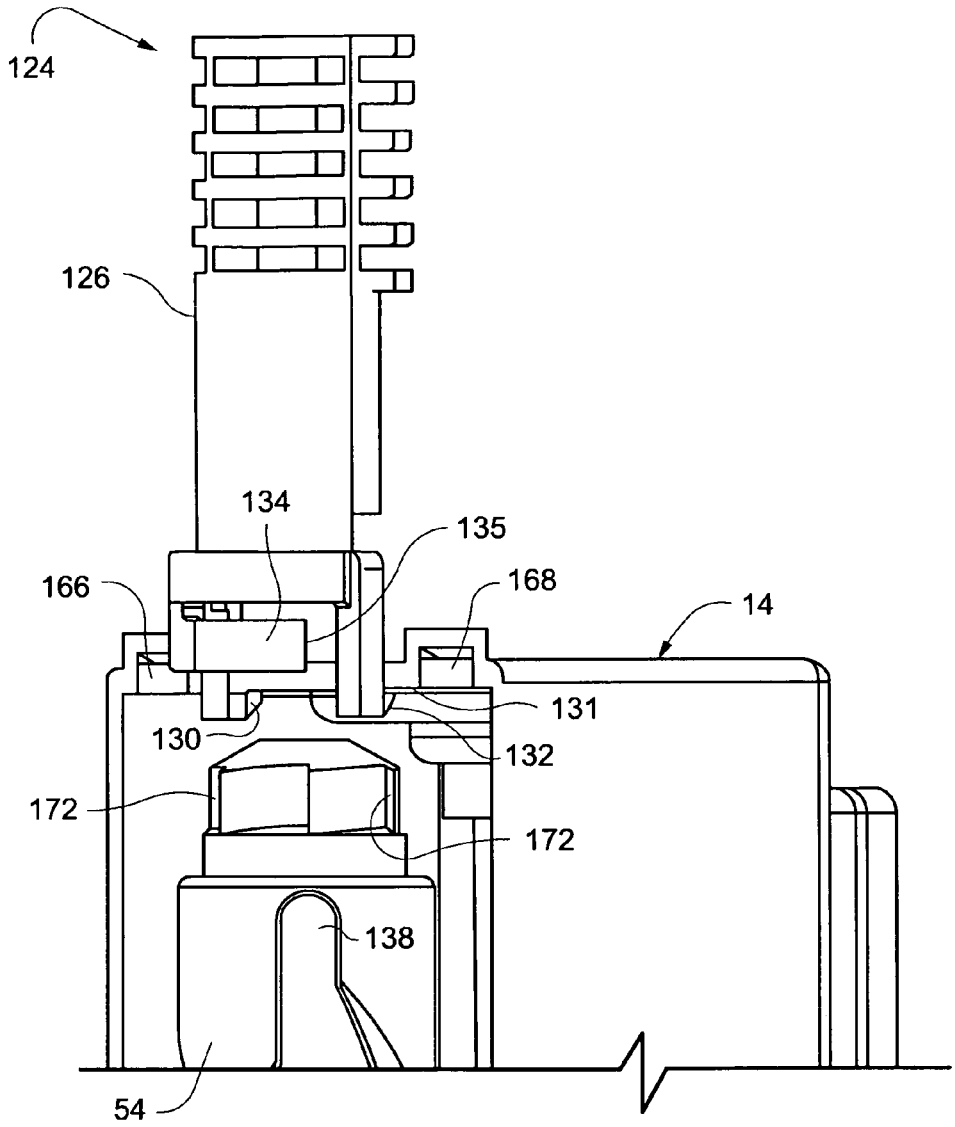
FIG. 37 is a partial elevation showing the retaining pin in a retracted position.
Figure 38:
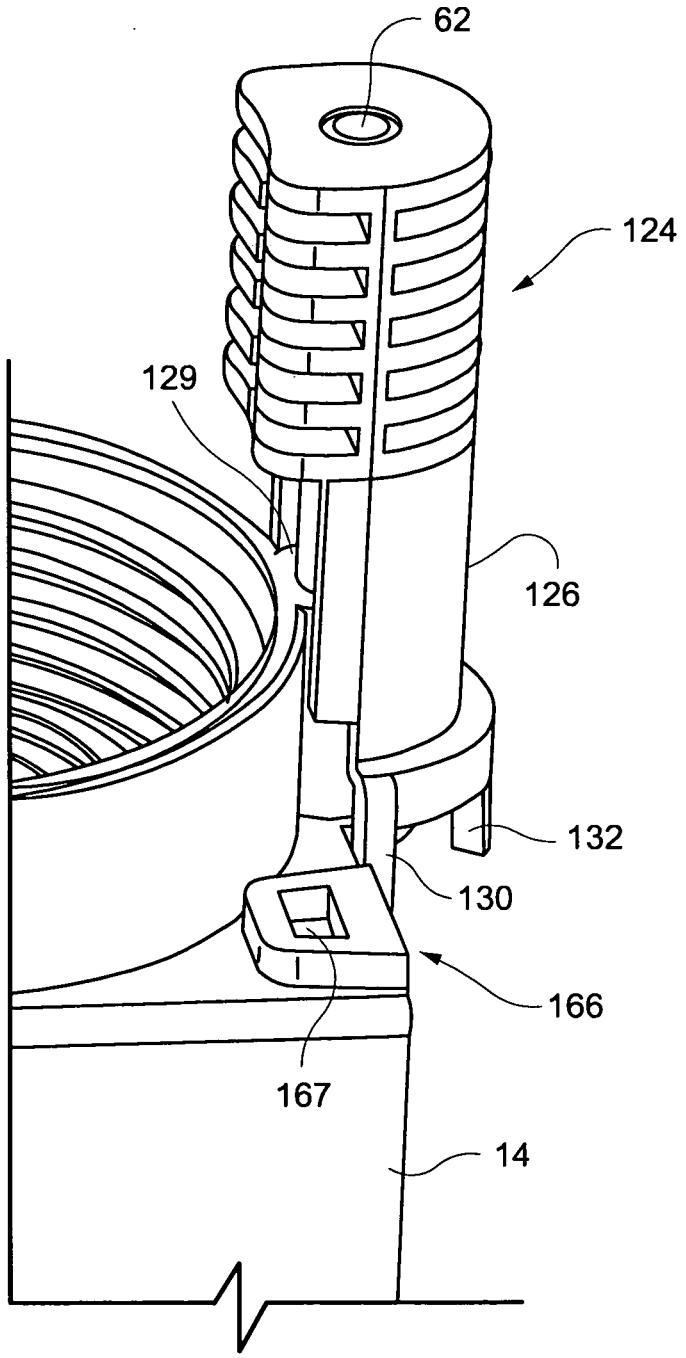
FIG. 38 is a partial perspective view of the retaining pin assembly in a retracted position.
Figure 39:
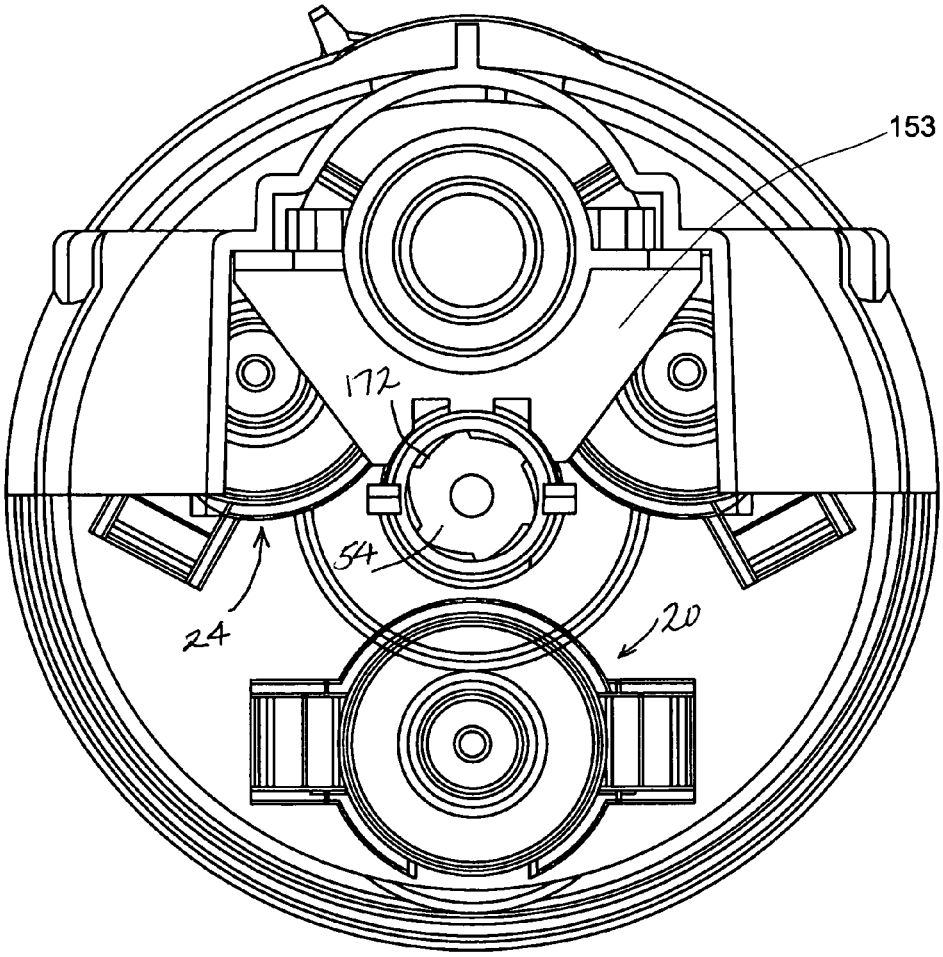
FIG. 39 is a partial top plan view showing how the nozzle insertion tool slides within the sprinkler housing.

A nozzle magazine retaining pin assembly 124 (FIGS. 2, 9, 16, 18, 27, 29, 31, 32 and 34-38) is utilized to lock the magazine 18 in place within the sprinkler housing 12 as best seen in FIG. 9. The nozzle magazine retaining pin assembly 124 includes an elongated retaining pin body 126 that supports the cylindrical lock or retaining pin 62 and a pair of stops 130, 132 at the lower end of the pin body 126. The lock or retaining pin 62 is pressed into a bore 133 in the retaining pin body 126 and remains stationary relative to that body. As shown in FIG. 34, the retaining pin 62 projects below the pin body 126, permitting the pin 62 to also extend through a bore 127 provided in a boss 129 formed on the housing 14, thus permitting the retaining pin assembly 124 to move up and down relative to the housing 14. The retaining pin 62 also projects below the boss 129 so that the pin may be inserted into and removed from the recess 56 at the top of the spindle 54. The stops 130, 132 engage under an edge 131 of the housing 14 to prevent removal of the retaining pin assembly 124 when the latter is in a retracted position. (See FIG. 37.) A horizontally-oriented tab 134 with a free edge 135 is formed adjacent the stops, the purpose for which will also be explained further herein.

Figure 28:
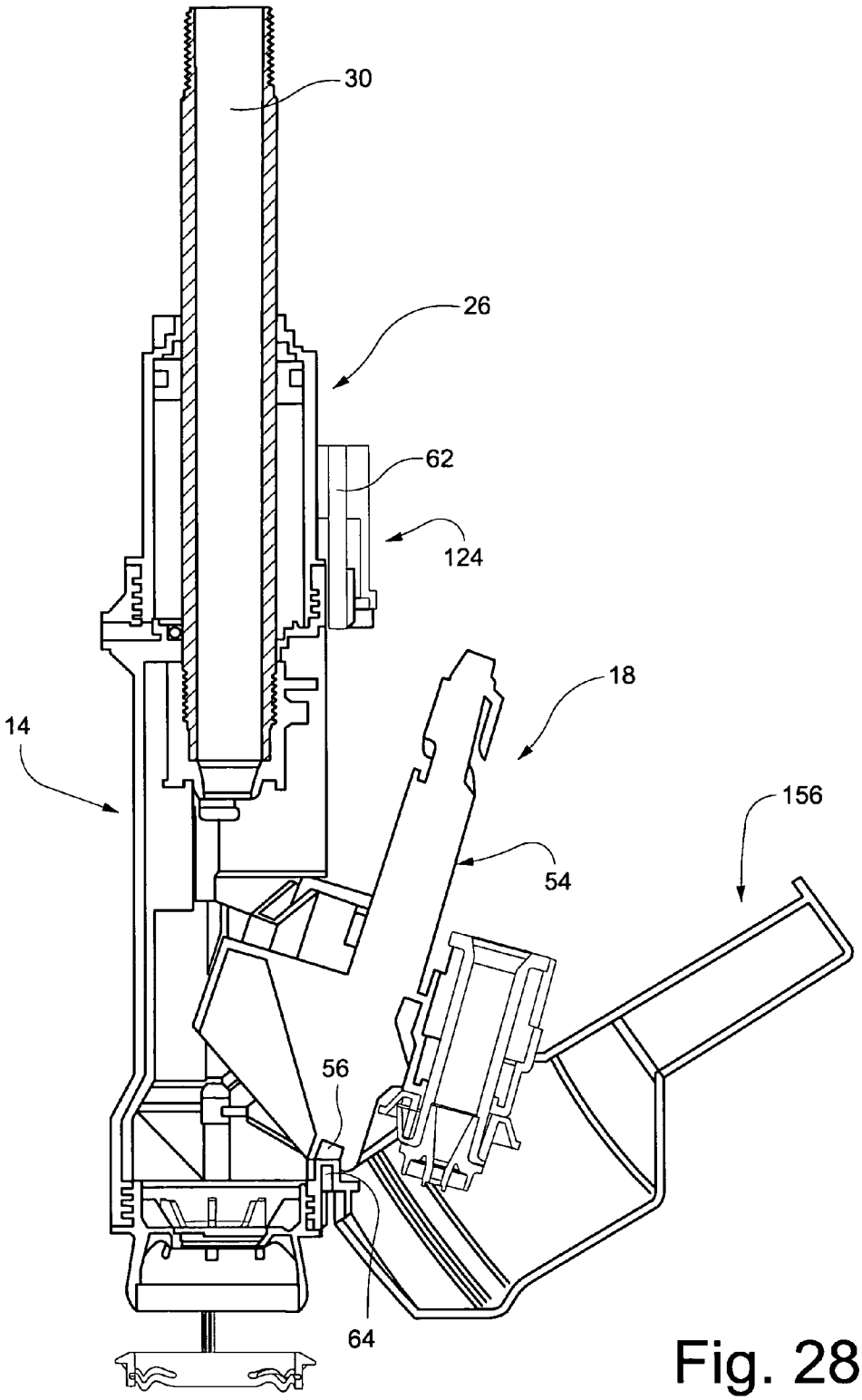
FIG. 28 is an isometric elevation illustrating the manner in which the nozzle magazine and an outer cover may be attached to the sprinkler and actuator assembly.
Figure 29:
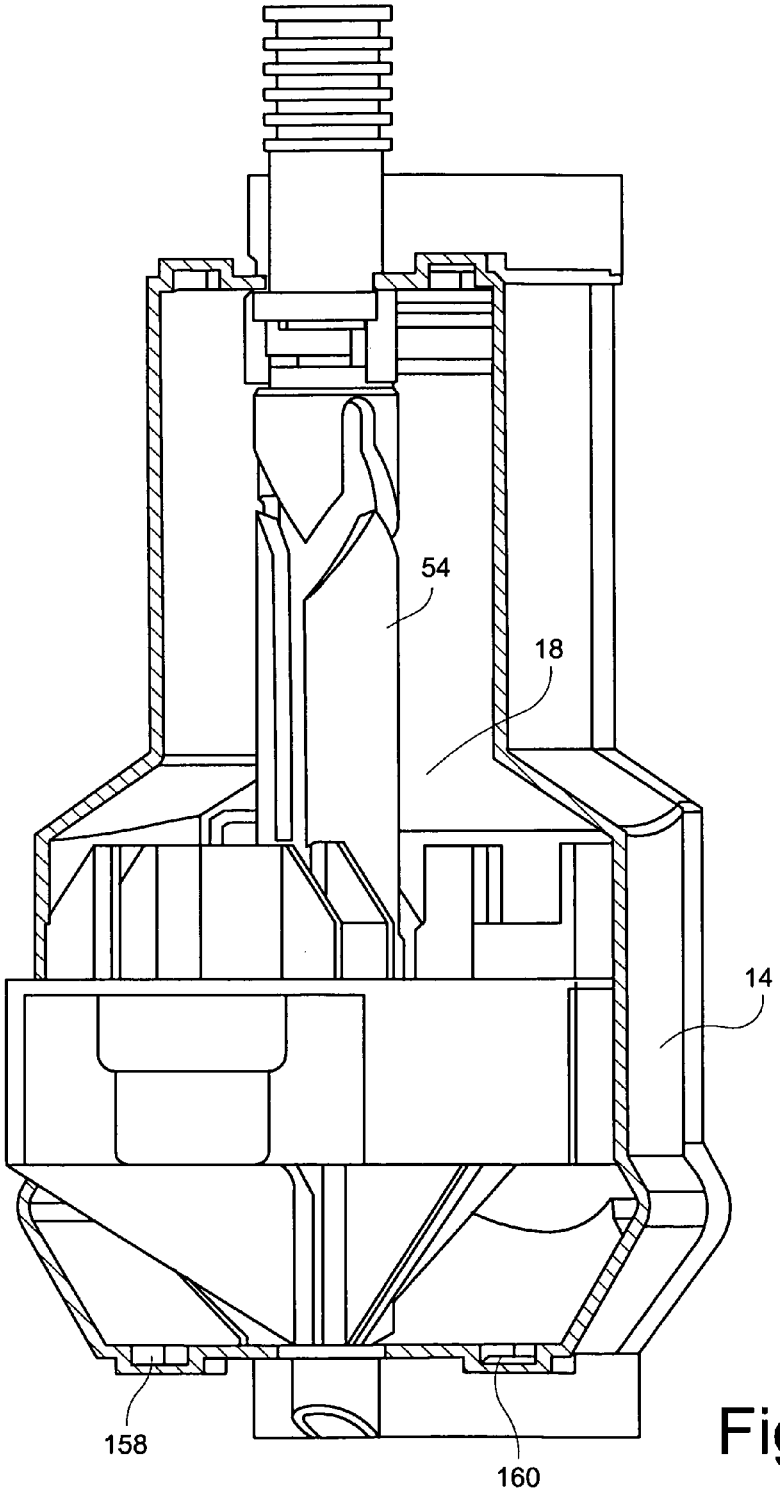
FIG. 29 is a side elevation illustrating a further aspect of the nozzle magazine retaining pin assembly.
Figure 32:
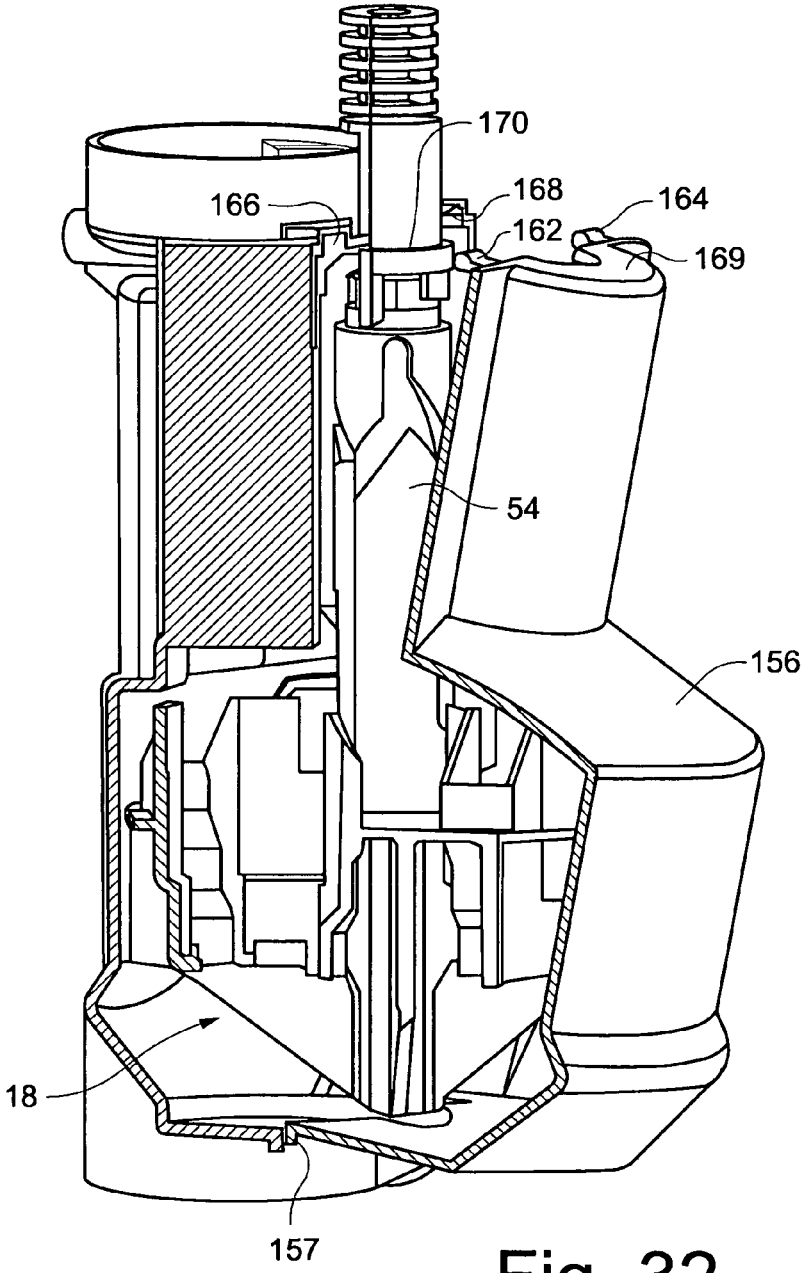
FIG. 32 is an elevation view showing the assembly of a cover to the open side of the housing.
Figure 33:
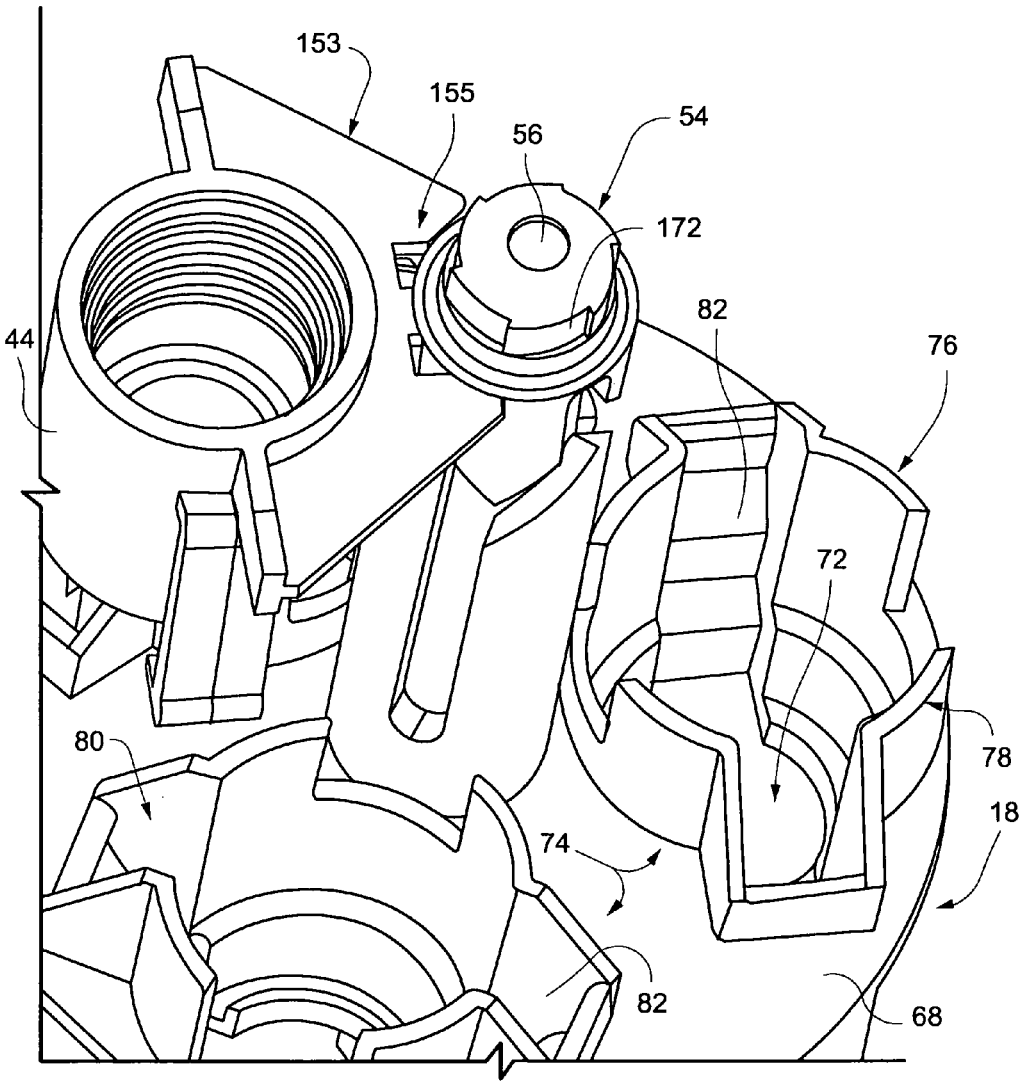
FIG. 33 is a partial perspective view showing a guide structure in the nosepiece engaged with the spindle.

Turning to FIG. 28, after the magazine 18 is loaded with nozzles 20, 22 and 24 by locating the latter in the lower ends of the respective sleeves 88 as described above, the magazine 18 is attached to the housing 14 by first locating the lower boss 64 in the lower recess 58. The magazine is then tilted upwardly to a substantially vertical position, enabling the retaining pin assembly 124 to be pushed downwardly such that the retaining pin 62 is engaged within the upper recess 56 in the spindle 54. (See, for example, FIGS. 16, 18 and 34-38.) As the magazine is pivoted upwardly, a guide plate 153 (FIG. 33) attached to the nosepiece 44 assists in the alignment of the spindle 54 by means of a multi-pronged recess 155. Once the nozzle magazine 18 is assembled in place within the housing 14, a removable outer cover 156, which covers the exposed nozzles (i.e., the nozzles not aligned with the actuator piston rod 30), is snapped into place (FIGS. 28, 29, 32). More specifically, the cover 156 may be made of a suitable transparent plastic material which enables the user to view the nozzles held in the magazine, and at the same time, prevents debris from entering the area where the actuator and nozzle magazine interface. The cover 156 spans approximately 180 degrees and attaches to the open side of the housing 14 at its lower end by means of a pair of tabs 157 (one shown in FIG. 32) receivable within a pair of recesses 158, 160, respectively, formed in the housing 14 (see FIG. 29). Because tabs 157 engaged in the recesses 158, 160 have down-turned edges, the cover 156 may pivot upwardly about its lower end so as to engage the housing 14 at its upper end. Specifically, tabs 162, 164 (FIG. 32) snap into open-ended bosses 166, 168 (FIGS.

32, 35-38). Note that the tabs 162, 164 have enlarged, rounded ends so that they will snap into the recesses, with the enlarged, rounded ends moving into openings 167 formed at the top of the respective bosses, best seen in FIG. 38. At the same time, a horizontal, arcuate surface 169 at the top of the cover 156 (FIG. 32) will seat on an arcuate shoulder 170 on the retaining pin body 126.

Returning to FIG. 9, when the nozzle magazine 18 is located such that the boss 64 is received in recess 58 and the retaining pin 62 is received in the upper recess 56, the magazine 18 is rotatable to locate any one of the interchangeable nozzles 20, 22 and 24 into a position where the longitudinal axis of the selected nozzle and respective nozzle-holding sleeve 88 are coaxial with the longitudinal axis of the actuator piston rod 30.

In the assembled configuration, a horizontally oriented nub or cam post 136 on the nosepiece 44 engages one of three axially-oriented upper axial groove portions 138 of an otherwise compound cam slot or groove 140 formed in the spindle 54. The three upper groove portions 138 are arranged at 60-degree intervals about the spindle. Each upper axial groove portion 138 communicates (or opens into) a pair of helically-configured groove portions 142 (advance) and 144 (retract). The advance groove portion 142 and retraction groove portion 144 meet at an upper apex 146 that is laterally offset from the longitudinal axis of the upper axial groove portion 138. At the same time, the adjacent groove portions 144, 142 meet at a lower apex 148 that is axially offset from a lower axial groove portion 150. The movement of the cam post 136 within the compound cam groove 140 during a complete nozzle-change cycle will be described further below.

Operation

Figure 13:
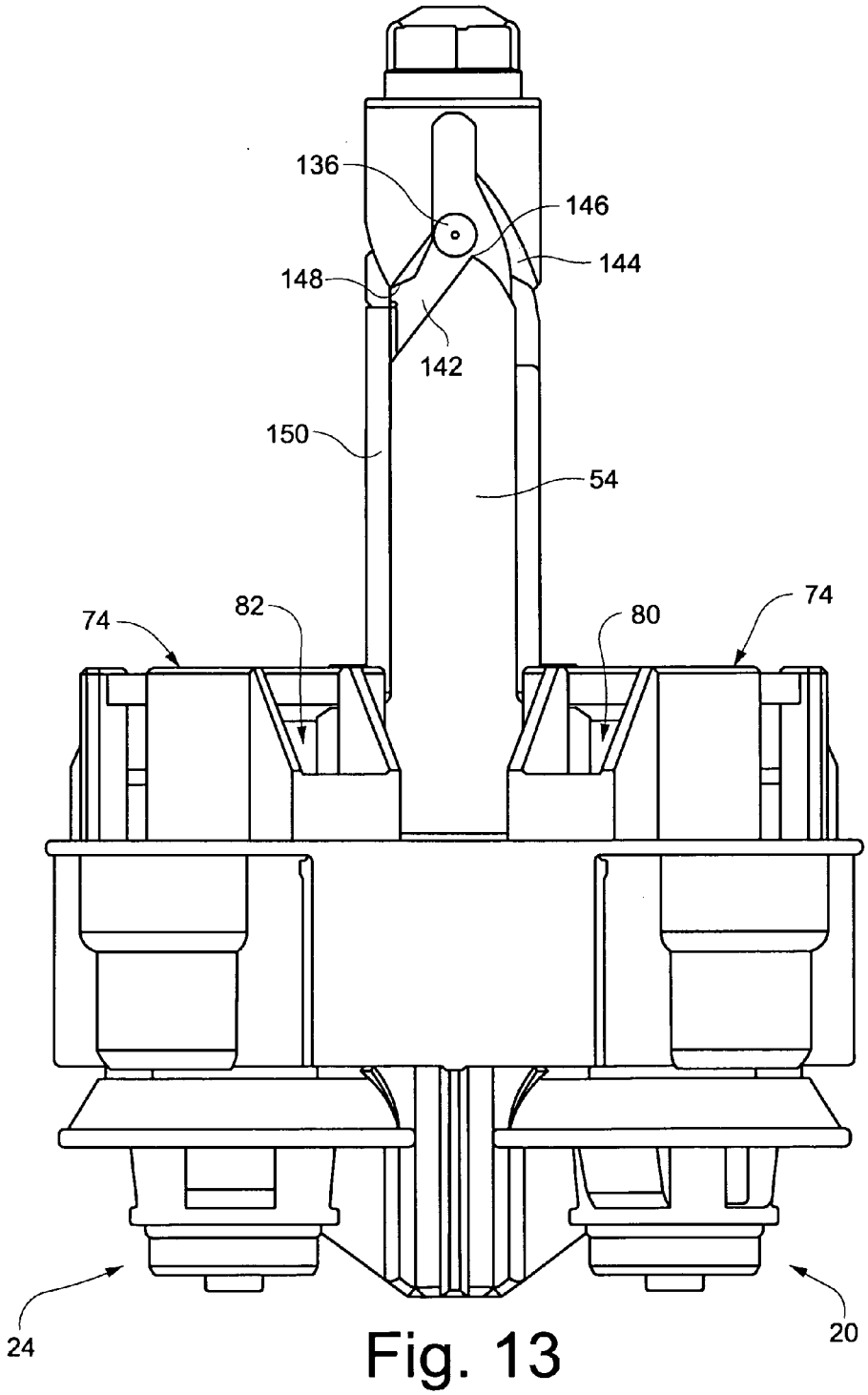
FIG. 13 is a view similar to FIG. 12 but with the actuator cam post shown at the lower end of the upper axial portion of the cam groove.
Figure 14:
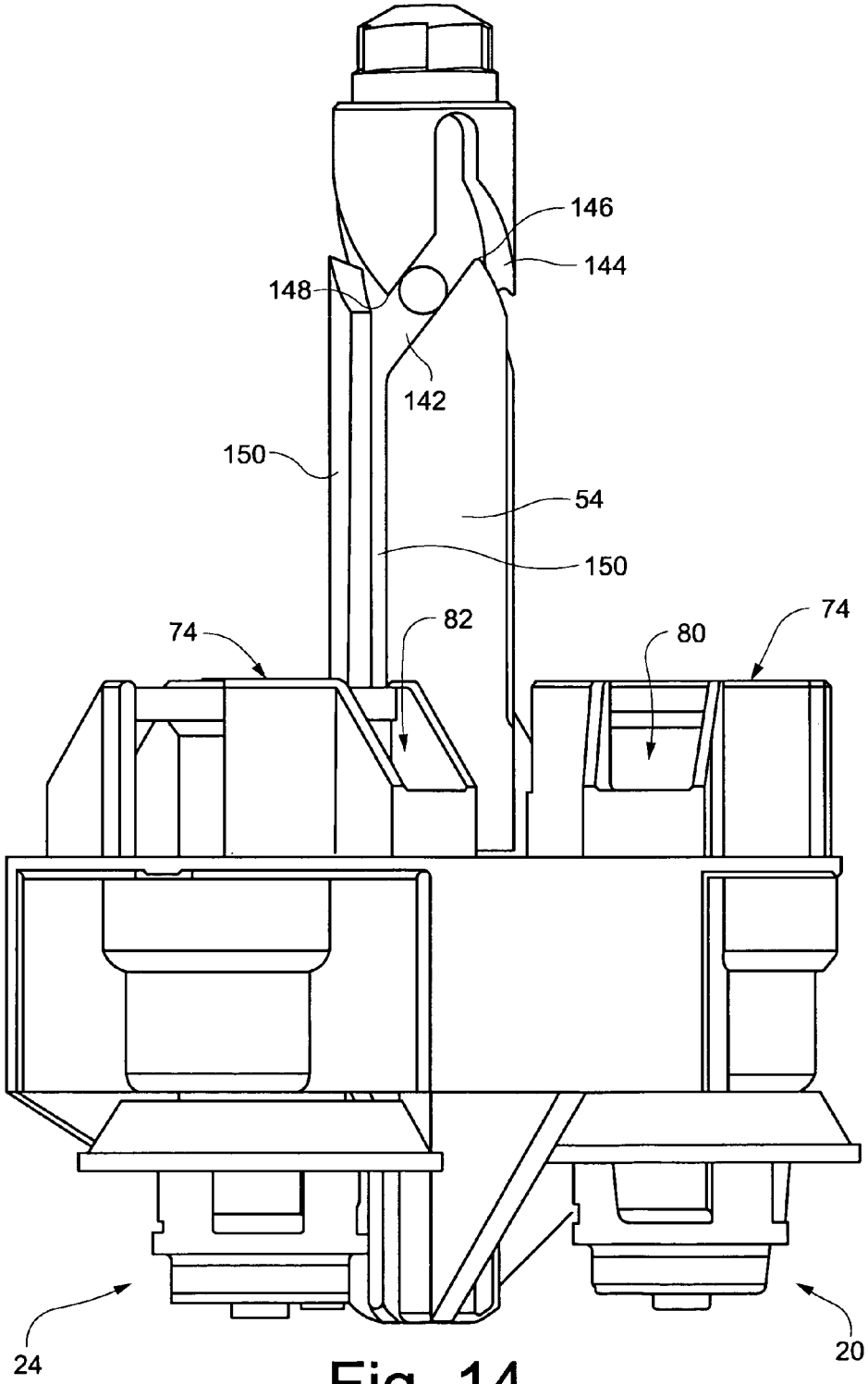
FIG. 14 is a view similar to FIG. 13 but with the actuator cam post shown in a further downwardly advanced position within the helical advance portion of the cam groove, and with the nozzle magazine rotated to the right.
Figure 15:
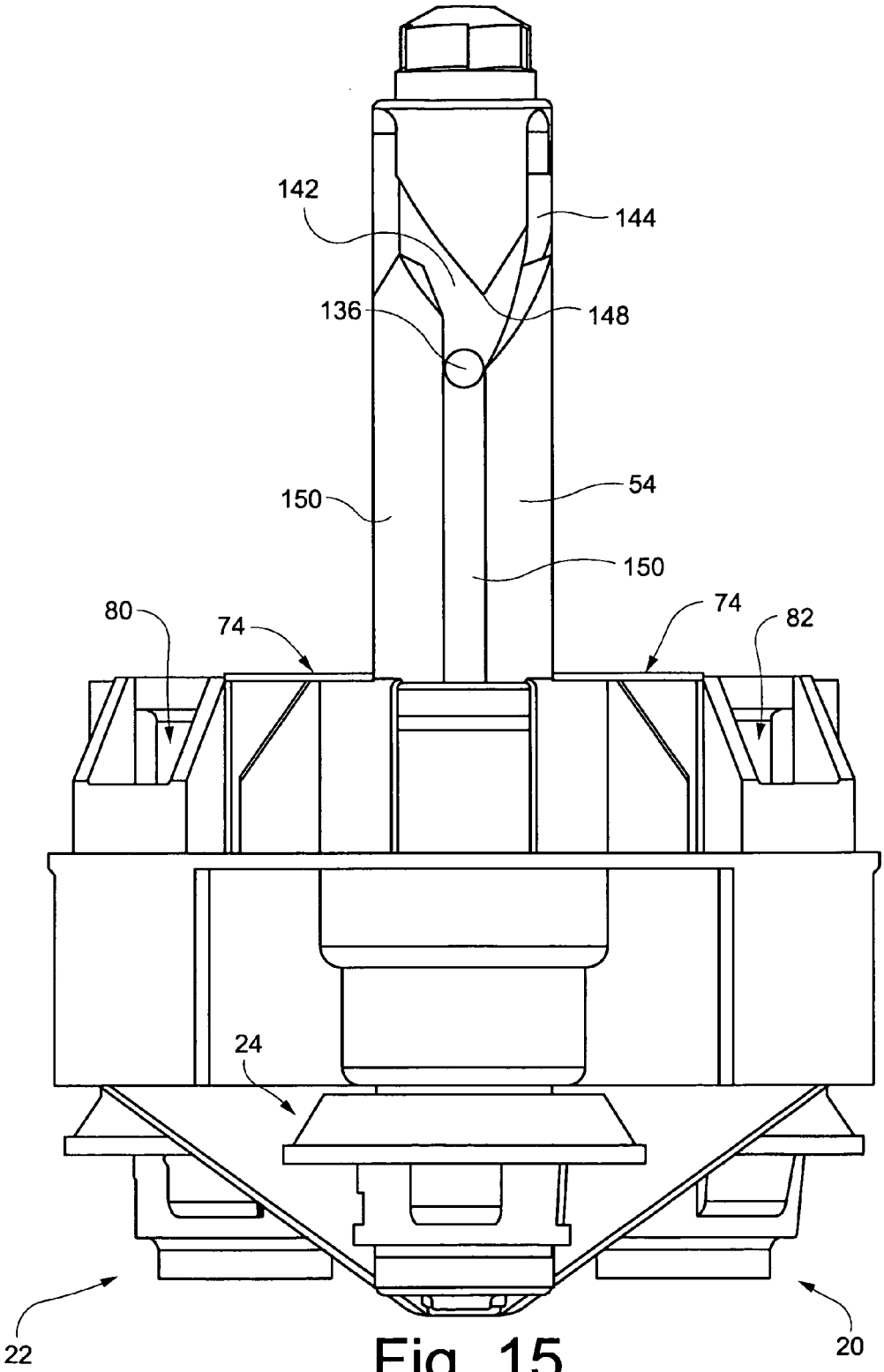
FIG. 15 is a view similar to FIG. 14 but with the actuator cam post shown in still further downwardly advanced position at the upper end of the lower axial portion of the cam groove, and with the nozzle magazine rotated further to the right.

With reference now to FIGS. 9-12, the actuator piston rod 30 is shown in its fully-retracted position, with the nosepiece 44 spaced axially above the nozzle-supporting sleeves 88 in the magazine tray body 66. In this position, the gripper arms 48 of the nosepiece 44 are in a normally outwardly-sprung position and the horizontal cam post 136 is located within one of the upper axial groove portions 138. This arrangement is likely only to be observed before initial use when a selected nozzle is to be inserted into the sprinkler body 12. As best seen in FIGS. 13 and 14, as the piston rod 30 begins to advance in a downward direction, the horizontal cam post 136 will travel along the upper axial groove portion 138, catch the upper apex 146 and move into the helical advance groove portion 142 initiating a 60-degree rotational movement of the nozzle magazine 18 about its rotational axis. Thus, as the hollow piston rod 30 advances, the cam post 136 is exerting a downward force on the helical advance groove portion 142 causing rotation of the magazine 18. When the cam post 136 reaches the lower axial groove portion 150 (see FIG. 15), the rotational indexing portion of the advance cycle is complete, and the magazine 18 is locked in position as the hollow piston rod 30 continues to advance, causing the pusher surface 47 on the nosepiece 44 to push the nozzle sleeve 88 and hence nozzle 24 downwardly into the sprinkler body 12 as best seen in FIGS. 16-19. During this final axially-downward movement, the gripper arms 48 are cammed inwardly by a first tapered surface 83 in each of the opposed slots 80, 82, the camming movement timed to have the arms 48 compress inwardly and slide under the flange 90 on the sleeve 88 (see FIG. 19) when the cam post 136 is travelling in the lower axial groove portion 150. During this final downward movement of the piston rod 30 and nosepiece 44 to the fully extended position, the arms 48 slide along the straight, non-tapered portions 85 of the slots 80, 82. It will thus be appreciated that in the normal operating position, the piston rod 30 and nosepiece 44 are fully extended and hold the selected nozzle 24 in place within the sprinkler body 12, with water under pressure flowing through the hollow piston rod 30, sleeve 88 and nozzle 24.

Figure 17:
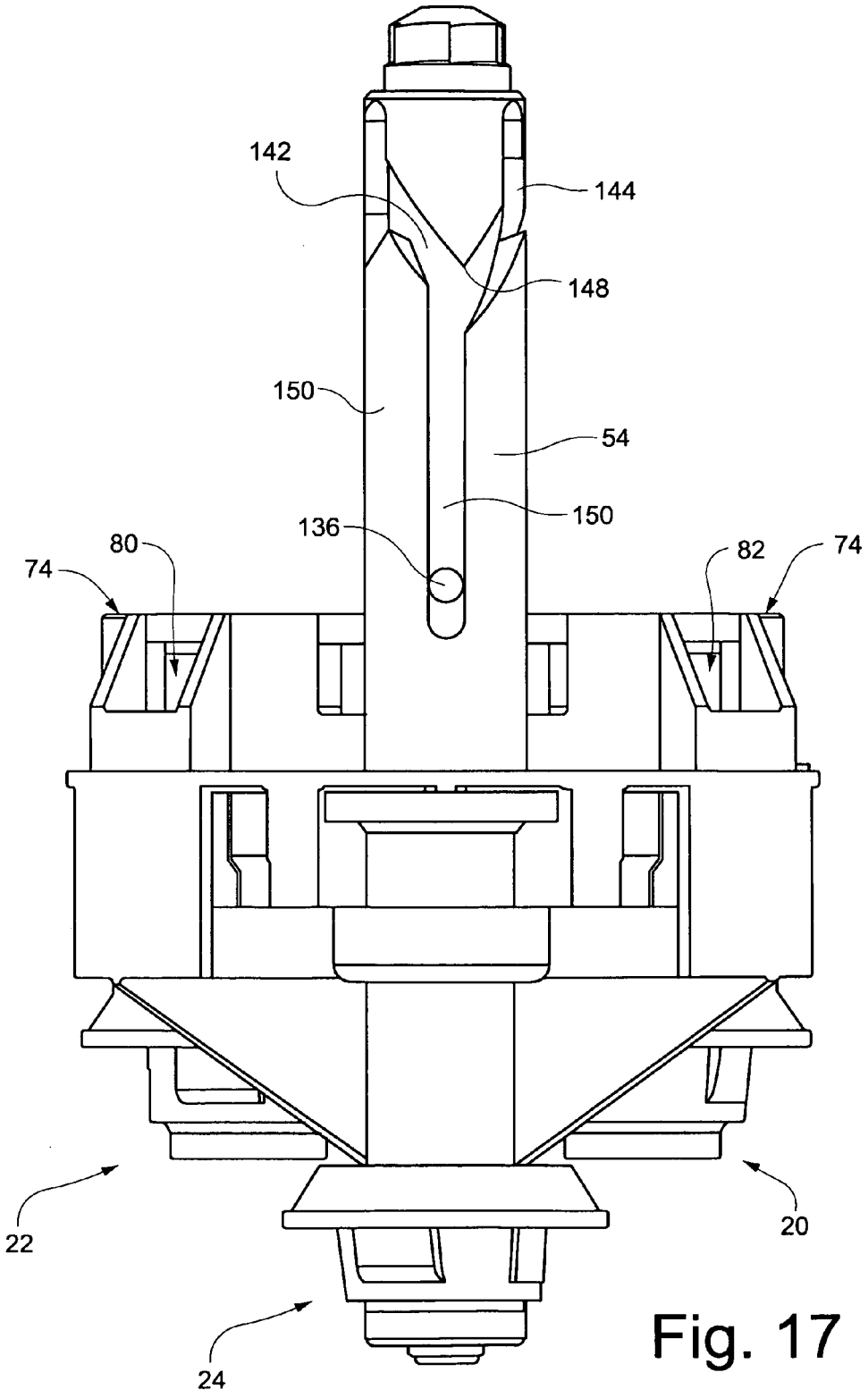
FIG. 17 is a view similar to FIG. 15, but with the actuator cam post in its fully advanced position at the lower end of the lower axial portion of the cam groove.
Figure 18:
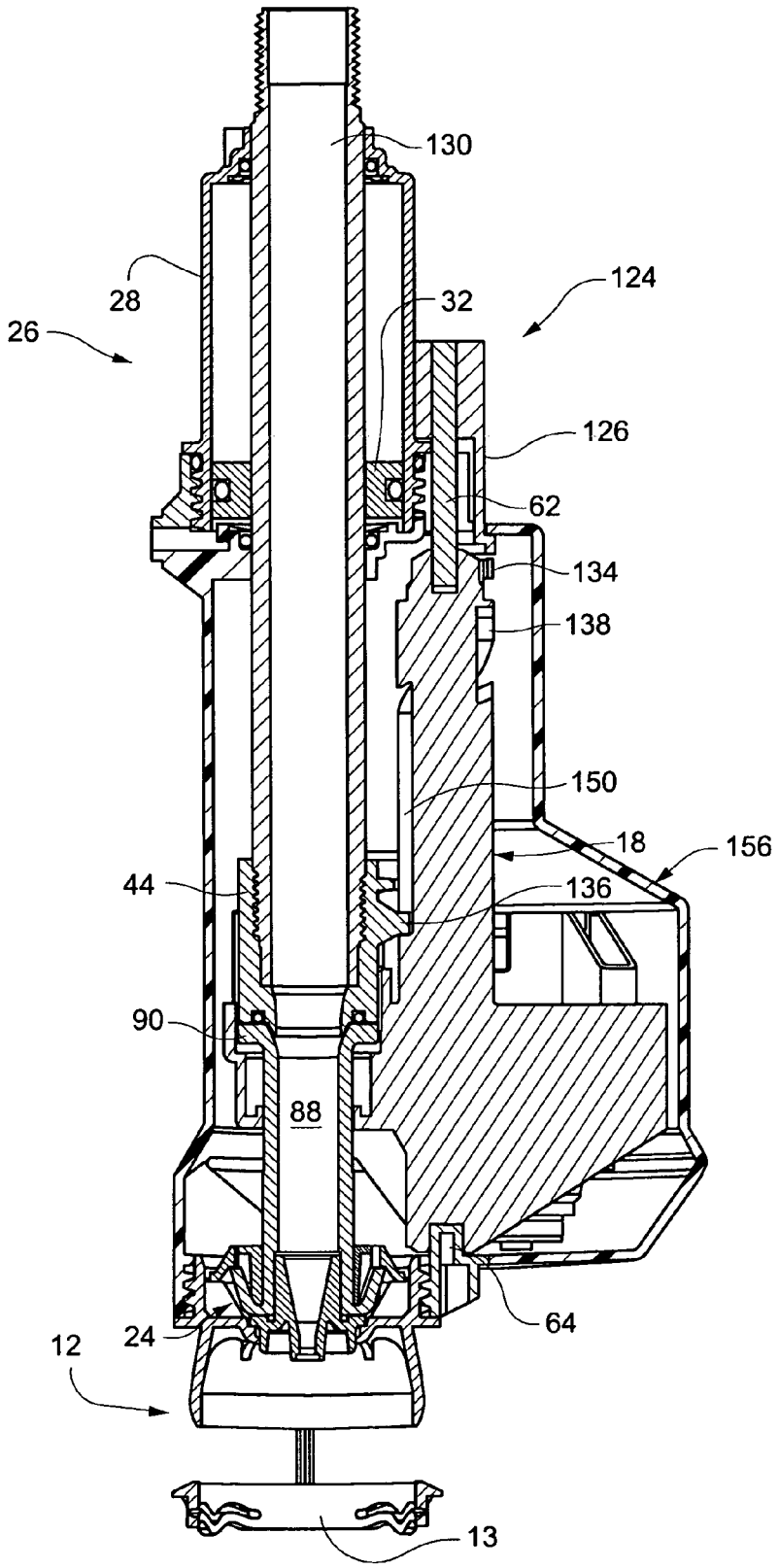
FIG. 18 is a section view of the sprinkler and nozzle changer assembly with the actuator cam post in a position corresponding to the actuator position shown in FIG. 17.
Figure 19:
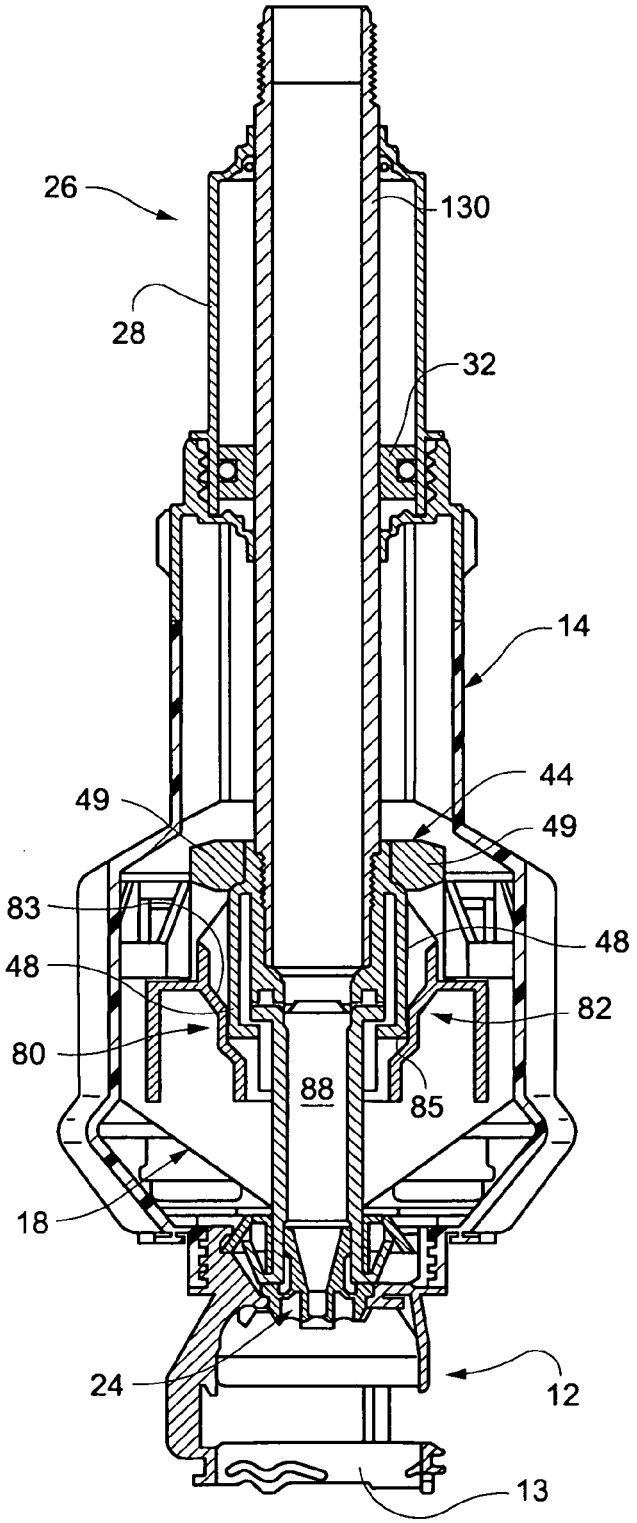
FIG. 19 is a section view similar to FIG. 18 but with the actuator head and nozzle magazine rotated 90° to the right.
Figure 20:
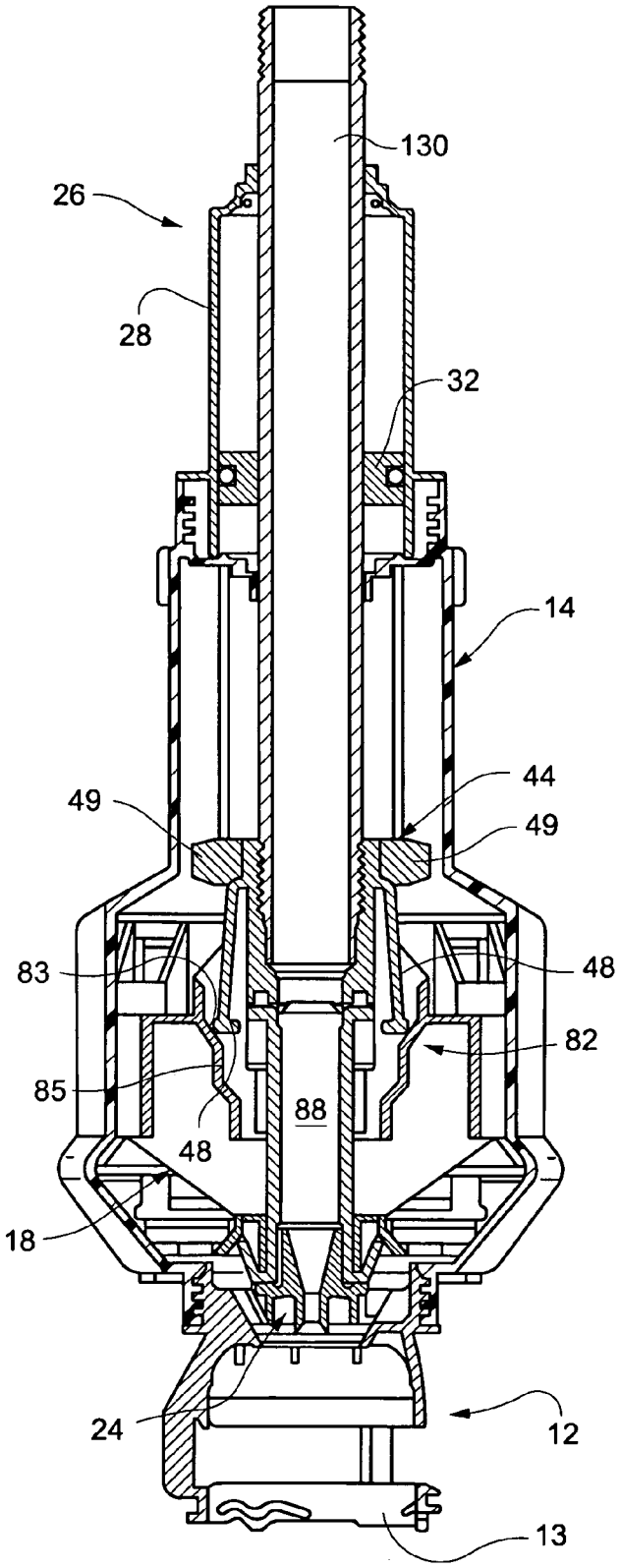
FIG. 20 is a section view similar to FIG. 19 but illustrating the nozzle changer actuator assembly in a partially retracted position.
Figure 21:
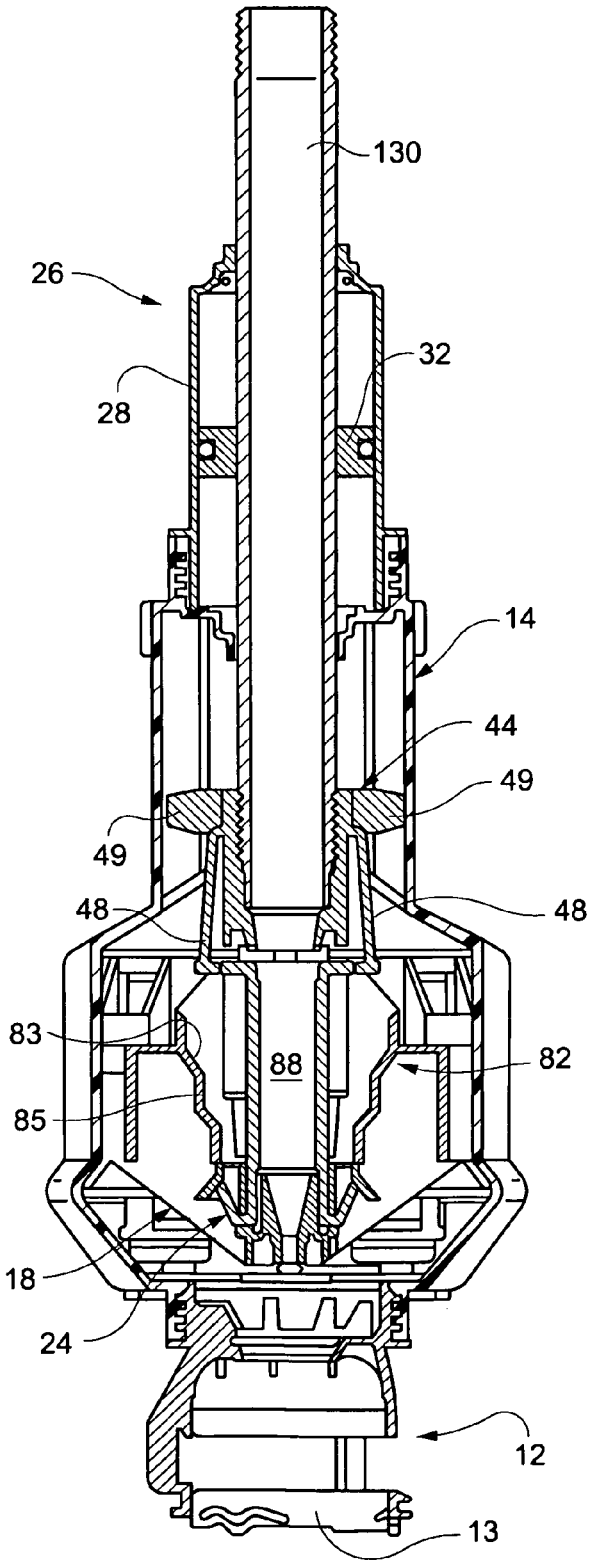
FIG. 21 is a view similar to FIG. 20 but illustrating the actuator in a further retracted position.
Figure 22:
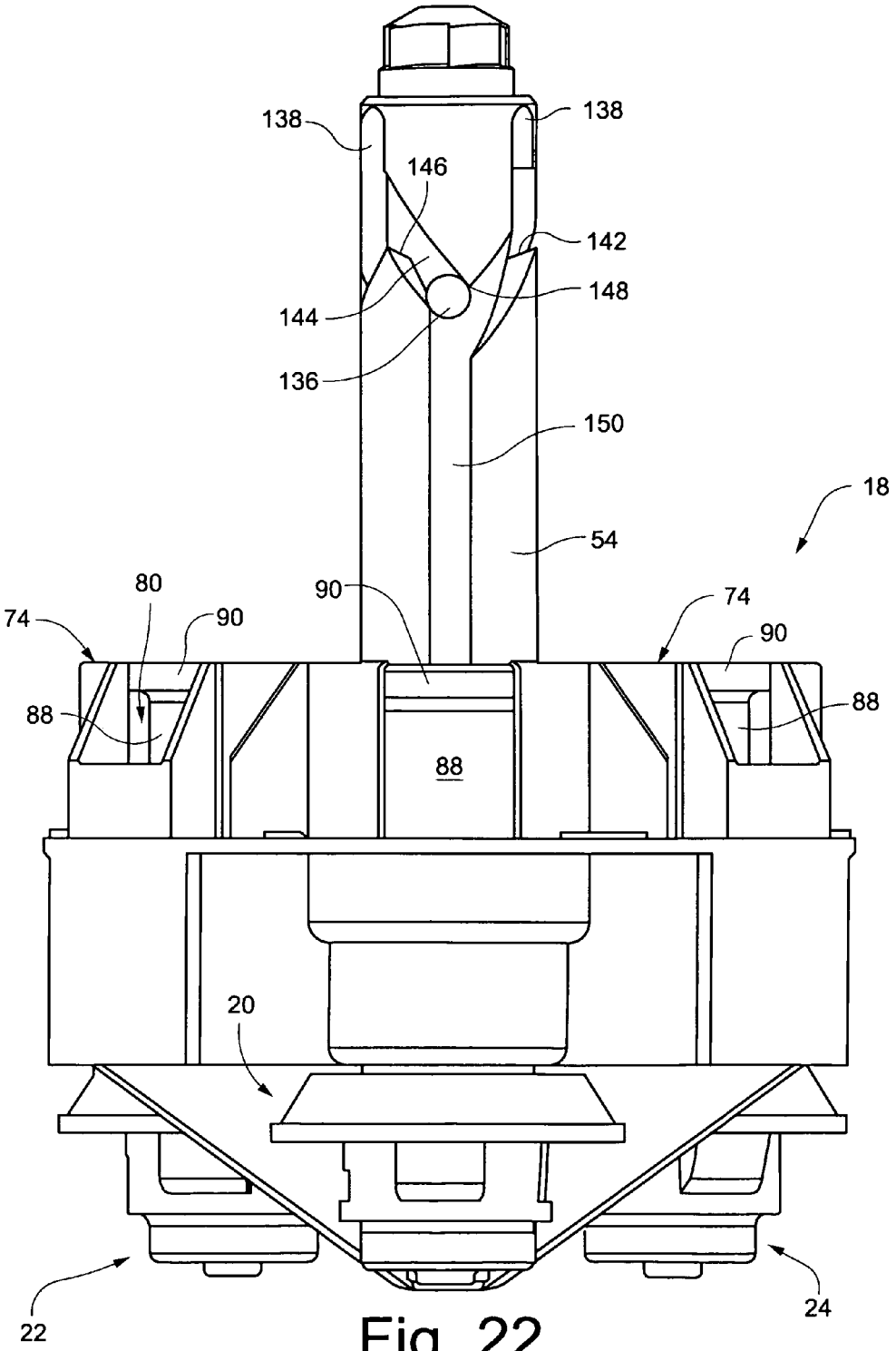
FIG. 22 is an elevation of the nozzle magazine generally corresponding to FIG. 21 showing the actuator cam post at the end of its movement in the lower axial retraction portion of the cam groove.
Figure 23:
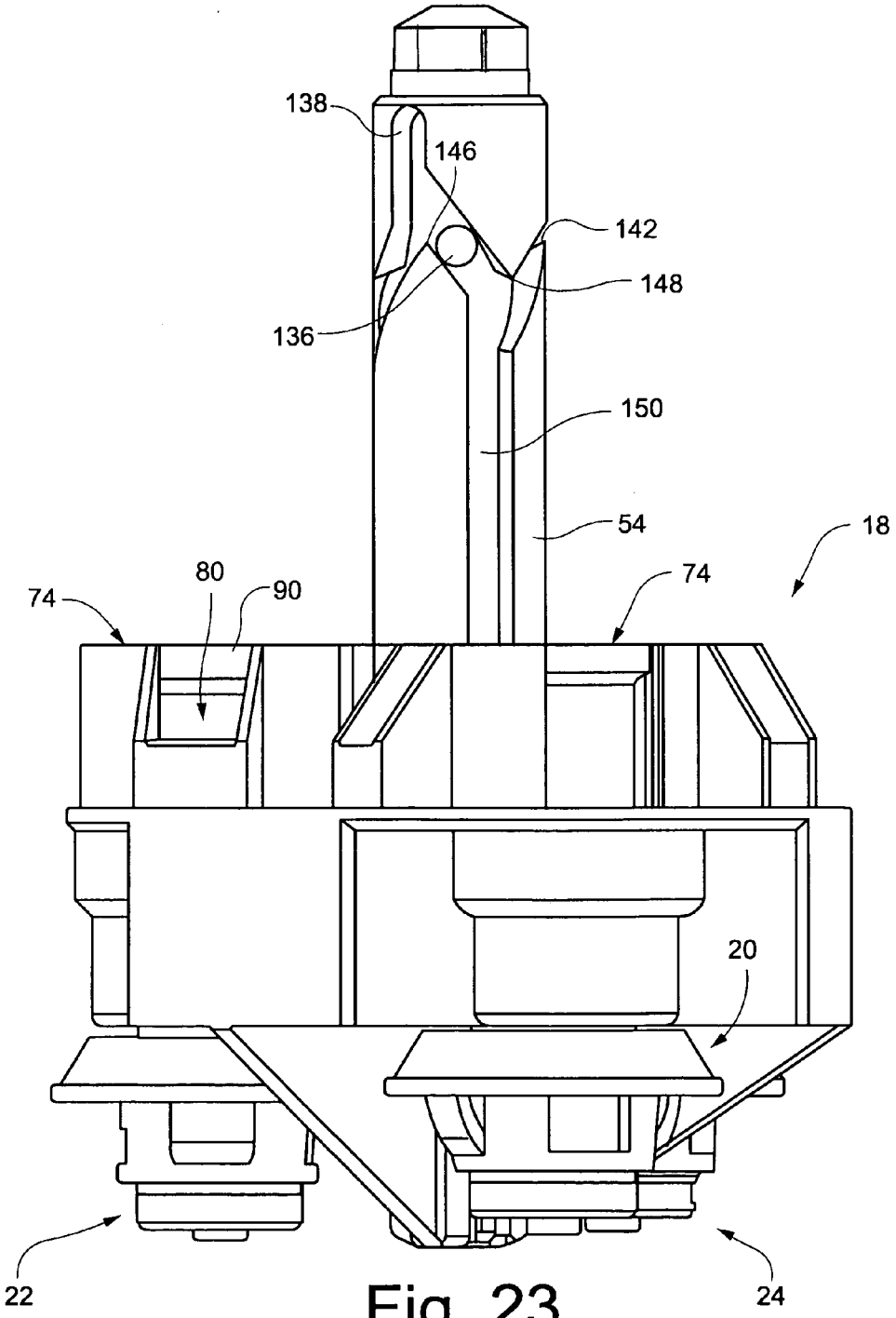
FIG. 23 is an elevation of the nozzle magazine similar to FIG. 22 but with the actuator cam post in a helical retraction portion of the cam groove.
Figure 24:
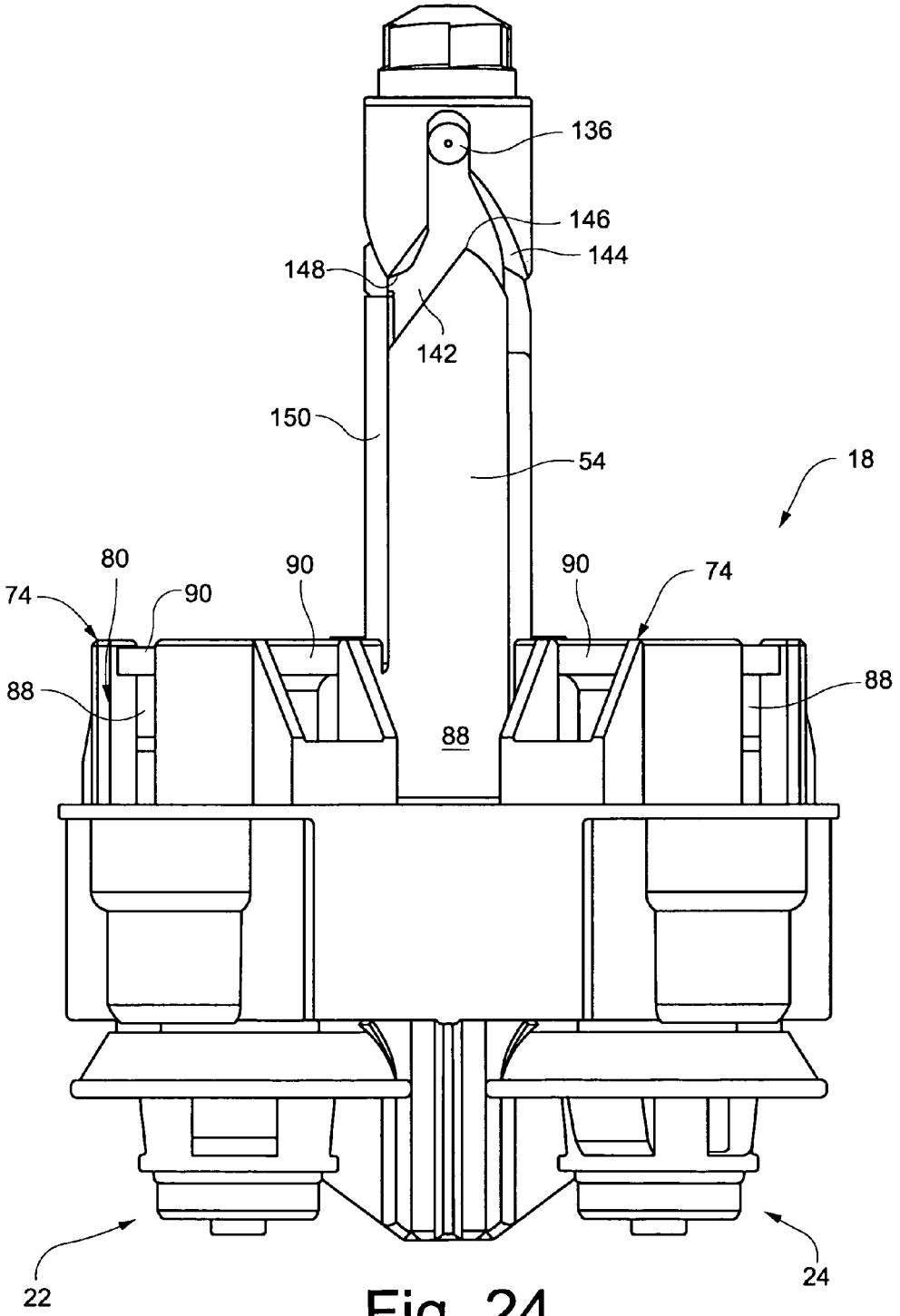
FIG. 24 is a view similar to FIG. 23 but illustrating the actuator cam post in its fully retracted position within the upper axial portion of the cam groove.
Figure 25:
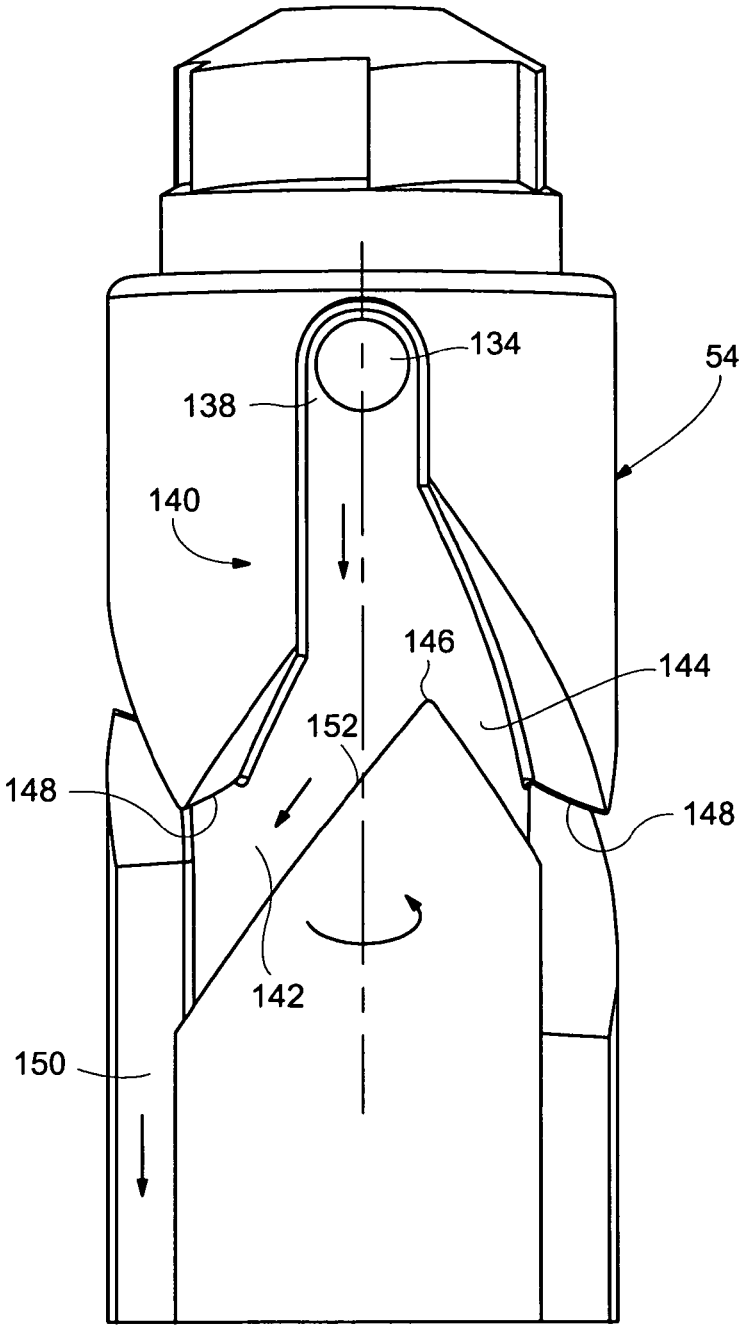
FIG. 25 is an enlarged partial side elevation of the cam groove in the spindle portion of the nozzle magazine.
Figure 26:
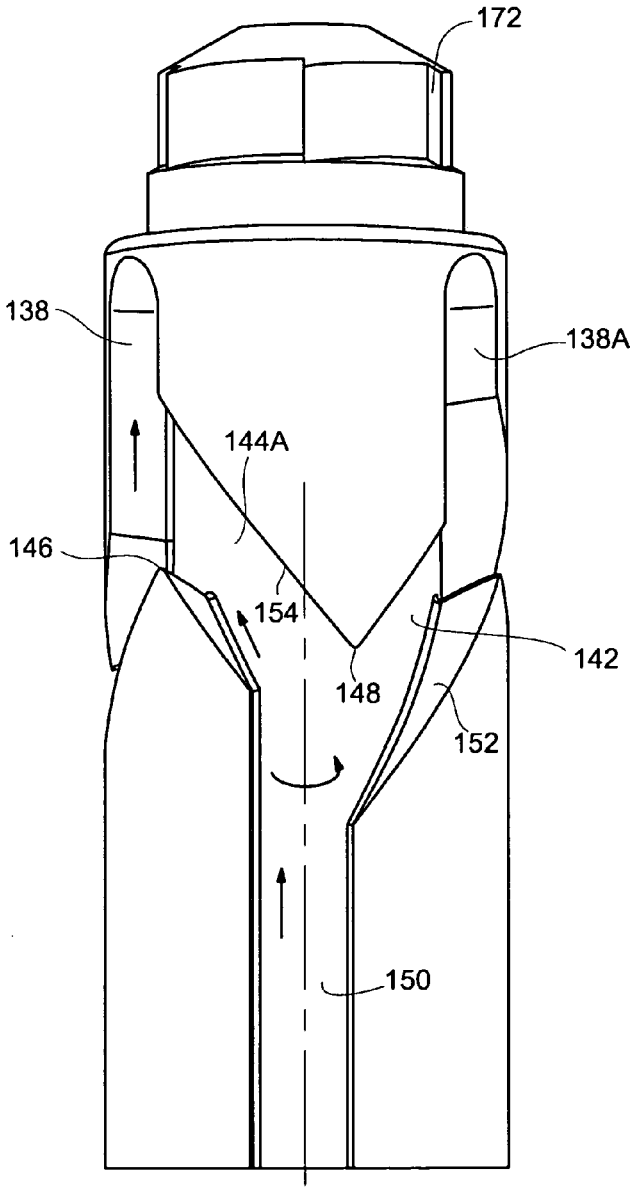
FIG. 26 is a partial side elevation similar to FIG. 25 but rotated 30° to the right.
Figure 27:
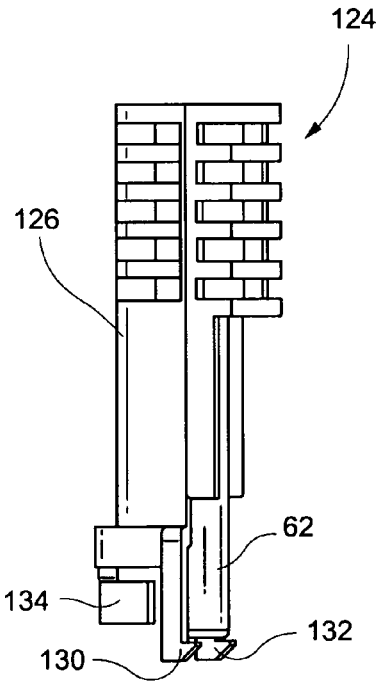
FIG. 27 is a side elevation view of a nozzle magazine retaining pin assembly.

When it is desired to change the flow rate of the installed nozzle 24, a nozzle-change cycle is commenced by a command to the actuator 26 to drive the hollow piston 30 in an upward or retraction direction (from the position shown in FIGS. 17 and 19). Upon initial upward, axial movement, with the cam post 136 travelling in the lower axial groove portion 150, the gripper arms 48, located underneath the upper annular flange 90 on the nozzle sleeve 88, will pull the sleeve and nozzle 24 upwardly out of, and away from, the sprinkler body 12. During further axial retraction movement (as the cam post 136 continues to ride in the lower axial groove portion 150), the gripper arms 48 (as well as pusher surface 47) will release from the sleeve flange 90 as they slide up the tapered surfaces 83 of the slots 80, 82. (See FIGS. 20, 21.) Further upward movement of the sleeve 88 and its attached nozzle is effected by the coil spring 114. Thus spring 114 insures that the sleeve 88 and nozzle 24 are raised sufficiently upwardly to permit rotation of the magazine 18 without interference. As the piston rod 30 continues to move upwardly, the cam post 136 will catch on the lower apex 148 (FIGS. 22, 23) and move into the helical retraction groove portion 144 causing a 60-degree rotation of the nozzle magazine 18 to the right (in the clockwise direction as viewed from below), rotating the retracted nozzle 24 away from the piston rod 30 while continuing to move upwardly. At the same time, the next adjacent nozzle 22 (and its respective sleeve 88) rotates toward the piston rod 30 and nosepiece 44. Following the 60-degree rotation caused by the retraction groove portion 144, the cam post 136 will reenter the next adjacent upper axial groove portion 138, completing the upward retraction movement. (See FIG. 24.)

Thereafter, movement of the actuator piston 30 is again reversed via further command to the actuator 26, and the piston rod 30 is driven downwardly to complete the rotation of the adjacent nozzle 22 into axial alignment with the piston rod 30 and nosepiece 44, and thereafter insert the newly selected nozzle 22 into the sprinkler body 12 in the same manner as described above in connection with the initial insertion of the nozzle 24 into the sprinkler body 12. It will thus be appreciated that a full nozzle-change cycle (retraction and advance movements) includes a 120-degree rotation of the nozzle magazine 18, including one 60-degree rotation of the magazine 18 on retraction of the installed nozzle, and a second 60-degree rotation on advancement and installation of the replacement nozzle.

Any further nozzle-change cycle to replace the second nozzle 22 with the third nozzle 20 occurs in the same manner, noting that each cycle starts with the cam post 136 in one of the three lower axial groove portions 150, and that identical helical retraction, helical advance and upper axial groove portions 138 are provided for each lower axial groove portion 150. In addition, it will be understood that one of the nozzles could be a "dummy" nozzle which has no orifice, thereby making it possible to shut off the flow of water through a particular sprinkler in accordance with a designed sprinkling regimen.

To further control the indexing rotation of the magazine 18, the uppermost portion of the spindle 54 is formed with six axially-extending position slots 172 spaced at 60-degree intervals about the spindle 54. (See FIG. 33.) The position slots correspond to the incremental 60-degree rotations of the magazine 18, such that the edge 135 of the horizontal, arcuate tab 134 on the retaining pin body 126 will engage an edge of a position slot 172 at the completion of each 60-degree rotation of the magazine. (See FIG. 36.) The position slots insure that the cam post 136 on the nosepiece 44 will properly engage the helical portions of the compound cam groove 140 on the spindle 54 as it transitions from the axial groove portions to the helical groove portions each time the actuator advances or retracts. In this regard, the position slots 172 also prevent the spindle from rotating backward in an opposite direction.

As will be appreciated by those skilled in the art, the above-described cycle may be implemented automatically at the same or varied time intervals by a suitable programmed microprocessor via GPS, radio signals (infrared or RFID), etc. either at the site or at a remote site.

It will also be appreciated that various aspects of the nozzle changer may be varied but remain within the scope of the invention. For example, the manner in which the magazine 18 is attached to the housing 14 and actuator 26, and the manner in which the cover 156 is attached to the housing may be modified, using any suitable mechanical attachment mechanisms. Similarly, the retaining pin assembly 124 as described is merely exemplary of various moveable locking pin arrangements that might be employed. The choice of actuator and related seals is also within the skill of the art.

Accordingly, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A sprinkler assembly comprising:

a housing having an open side;

a sprinkler body supported at one end of said housing and adapted to receive a nozzle;

a nozzle magazine attached to said housing along said open side and holding plural nozzles selectively alignable with said sprinkler body; and an actuator for rotating the magazine to align a selected nozzle with a flow path through the sprinkler body and for moving the selected one of said plural nozzles relative to said nozzle magazine and linearly into said sprinkler body.

2. The sprinkler assembly of claim 1 wherein said actuator comprises a hydraulic or pneumatic cylinder attached to an opposite end of said housing.

3. The sprinkler assembly of claim 2 wherein a hollow piston rod moves within said cylinder, a free end of said hollow piston rod mounting a nozzle insertion tool.

4. The sprinkler assembly of claim 2 wherein said nozzle magazine includes a tray formed with plural openings, each opening receiving a substantially cylindrical nozzle sleeve, each of said plural nozzles supported in a respective nozzle sleeve.

5. The sprinkler assembly of claim 3 wherein said nozzle insertion tool comprises a pusher surface adapted to insert a selected one of said plural nozzles into said sprinkler body, and a pair of gripper arms adapted to remove another of said plural nozzles from said sprinkler body.

6. The sprinkler assembly of claim 5 wherein said pusher surface engages an upper end of said respective nozzle sleeve, and wherein said gripper arms are adapted to engage an underside of a radial flange formed at the upper end of said nozzle sleeve, each of said plural nozzles remaining in a respective nozzle sleeve upon insertion into said sprinkler body.

7. The sprinkler assembly of claim 1 wherein said plural nozzles comprise three nozzles, each having a different flow rate.

8. The sprinkler assembly of claim 4 wherein said nozzle magazine includes a spindle, said tray located adjacent one end of said spindle; wherein upper and lower ends of said spindle define an axis of rotation for said nozzle magazine relative to said housing.

9. The sprinkler assembly of claim 8 wherein an opposite end of the spindle is formed with a compound cam groove adapted for interaction with an actuator cam, said compound cam groove arranged to rotate the nozzle magazine in a first angular direction upon movement of said actuator cam in a first linear direction, and to rotate the nozzle magazine further in said first angular direction upon movement of said actuator cam in a second linear direction opposite said first linear direction.

10. The sprinkler assembly of claim 9 wherein said actuator cam comprises a horizontally-oriented cam post fixed to a nozzle insertion tool.

11. The sprinkler assembly of claim 3 wherein one end of said hollow piston rod is in fluid communication with said nozzle and an opposite end of said hollow piston rod is adapted to connect to a water supply conduit at an opposite end thereof, said hollow piston rod thus providing the flow path through the sprinkler body .

12. A sprinkler assembly comprising:

a housing having an open side;

a sprinkler body supported at one end of said housing and adapted to receive a nozzle;

a nozzle magazine attached to said housing along said open side and holding plural nozzles selectively alignable with said sprinkler body, said nozzle magazine further including a spindle, upper and lower ends of said spindle defining an axis of rotation for said nozzle magazine relative to said housing; and an actuator comprising a hydraulic or pneumatic cylinder for rotating the magazine about said axis of rotation to align a selected one of said plural nozzles with a flow path through the sprinkler body and for moving the selected one of said plural nozzles relative to said nozzle magazine and linearly into said sprinkler body.

13. The sprinkler assembly of claim 12 wherein an opposite end of the spindle is formed with a compound cam groove adapted for interaction with an actuator cam, said compound cam groove arranged to rotate the nozzle magazine in a first angular direction upon movement of said actuator cam in a first linear direction, and to rotate the nozzle magazine further in said first angular direction upon movement of said actuator cam in a second linear direction opposite said first linear direction.

14. The sprinkler assembly of claim 13 wherein a hollow piston rod moves within said cylinder, a free end of said hollow piston rod mounting a nozzle insertion tool comprising a pusher surface adapted to insert a selected one of said plural nozzles into said sprinkler body, and a pair of gripper arms adapted to remove another of said plural nozzles from said sprinkler body.

15. The sprinkler assembly of claim 14 wherein said actuator cam comprises a horizontally-oriented cam post fixed to said nozzle insertion tool.

16. The sprinkler assembly of claim 15 wherein one end of said hollow piston rod is in fluid communication with said nozzle and an opposite end of said hollow piston rod is adapted to connect to a water supply conduit at an opposite end thereof, said hollow piston rod thus providing the flow path through the sprinkler body.

17. A sprinkler assembly comprising:

a housing having an open side;

a sprinkler body supported at one end of said housing and adapted to receive a nozzle;

a nozzle magazine attached to said housing along said open side and holding plural nozzles selectively alignable with said sprinkler body, said nozzle magazine including a tray formed with plural openings, each opening receiving a substantially cylindrical nozzle sleeve, each of said plural nozzles supported in a respective nozzle sleeve;

an actuator for moving a selected one of said plural nozzles from said nozzle magazine into said sprinkler body, said actuator compromising a hydraulic or pneumatic cylinder attached to an opposite end of said housing; and wherein a hollow piston rod moves within said cylinder, a free end of said hollow piston rod mounting a nozzle insertion tool comprising a pusher surface adapted to insert a selected one of said plural nozzles into said sprinkler body, and a pair of gripper arms adapted to remove another of said plural nozzles from said sprinkler body, and further wherein each opening in said tray is formed with diametrically-opposed cam slots adapted to engage and compress said gripper arms about said sleeve.

* * * * *